US010780328B1

(12) United States Patent
Beno et al.

(10) Patent No.: US 10,780,328 B1
(45) Date of Patent: Sep. 22, 2020

(54) GOLF CLUB WITH AERODYNAMIC FEATURES ON CLUB FACE

(71) Applicant: Cobra Golf Incorporated, Carlsbad, CA (US)

(72) Inventors: Tim A. Beno, San Diego, CA (US); Michael S. Yagley, Carlsbad, CA (US); Cameron J. Day, Vista, CA (US)

(73) Assignee: COBRA GOLF INCORPORATED, Carlsbad, CA (US)

( * ) Notice: Subject to any disclaimer, the term of this patent is extended or adjusted under 35 U.S.C. 154(b) by 0 days.

(21) Appl. No.: 16/249,317

(22) Filed: Jan. 16, 2019

Related U.S. Application Data

(63) Continuation of application No. 15/618,414, filed on Jun. 9, 2017, now Pat. No. 10,213,660, which is a continuation-in-part of application No. 15/409,114, filed on Jan. 18, 2017, now abandoned.

(60) Provisional application No. 62/445,965, filed on Jan. 13, 2017.

(51) Int. Cl.
*A63B 53/04* (2015.01)
*A63B 60/00* (2015.01)

(52) U.S. Cl.
CPC ..... *A63B 53/0466* (2013.01); *A63B 60/00* (2015.10); *A63B 2053/0408* (2013.01); *A63B 2053/0437* (2013.01); *A63B 2053/0445* (2013.01); *A63B 2060/006* (2015.10)

(58) Field of Classification Search
CPC ..... A63B 2053/0445; A63B 53/0466; A63B 60/00; A63B 2053/0408; A63B 2060/006; A63B 2053/0437
See application file for complete search history.

(56) References Cited

U.S. PATENT DOCUMENTS

| | | | |
|---|---|---|---|
| 1,968,626 | A | 7/1934 | Young |
| 2,034,936 | A | 3/1936 | Barnhart |
| 3,975,023 | A | 8/1976 | Inamori |
| 4,022,033 | A | 5/1977 | Schieber et al. |
| 4,635,941 | A | 1/1987 | Yoneyama |
| 4,754,974 | A | 7/1988 | Kobayashi |
| 5,090,702 | A | 2/1992 | Viste |

(Continued)

FOREIGN PATENT DOCUMENTS

| | | | | |
|---|---|---|---|---|
| JP | 2009000281 | A | 1/2009 | |
| JP | 2017205359 | A * | 11/2017 | ..... A63B 53/0466 |

OTHER PUBLICATIONS

Translation of JP2009000281 retrieved from Espacenet on Aug. 17, 2017 (8 pages).

(Continued)

*Primary Examiner* — Stephen L Blau
(74) *Attorney, Agent, or Firm* — Quarles & Brady LLP

(57) ABSTRACT

The invention provides golf club heads having aerodynamic features that disrupt air flow over the face when the club is swung. The features are milled into the face of the club head, including curved faces found in wood-type club heads. During a swing, the features cause the boundary layer to separate at a point closer to the rear of the club head during a swing, resulting in reduced drag. The invention also provides golf club heads with faces having a central region of symmetrical surface roughness. The symmetrical roughness in the central region of the face of wood-type club heads allows for shots with less spin and greater distance.

19 Claims, 19 Drawing Sheets

(56) References Cited

U.S. PATENT DOCUMENTS 5,100,144 A * 3/1992 Okumoto ..... A63B 53/04 473/331
5,398,929 A 3/1995 Kitaichi
D366,682 S 1/1996 Antonious
D378,770 S 4/1997 Hlinka et al.
5,676,605 A 10/1997 Kobayashi
5,700,208 A 12/1997 Nelms
5,762,567 A 6/1998 Antonious
5,816,936 A 10/1998 Aizawa et al.
5,879,243 A 3/1999 Hackman
5,993,329 A 11/1999 Shieh
6,001,030 A 12/1999 Delaney
6,042,486 A 3/2000 Gallagher
6,093,116 A 7/2000 Hettinger et al.
6,146,285 A 11/2000 Winslow
6,267,690 B1 * 7/2001 Salmon ..... A63B 53/04 473/325
6,348,013 B1 2/2002 Kosmatka
6,787,091 B2 9/2004 Dalton et al.
7,059,972 B2 * 6/2006 Miyamoto ..... A63B 53/04 473/330
7,066,833 B2 6/2006 Yamamoto
7,281,992 B2 10/2007 Tseng
7,285,057 B2 10/2007 Mann, Jr. et al.
7,588,503 B2 9/2009 Roach et al.
7,674,188 B2 * 3/2010 Ban ..... A63B 53/047 473/330
7,811,179 B2 10/2010 Roach et al.
7,811,180 B2 10/2010 Roach et al.
7,815,521 B2 * 10/2010 Ban ..... A63B 53/04 473/330
7,909,708 B2 * 3/2011 Gilbert ..... A63B 53/04 473/330
7,988,565 B2 8/2011 Abe
8,007,369 B2 8/2011 Soracco
8,096,896 B2 1/2012 De Schiell et al.
8,172,698 B2 5/2012 Solheim
8,282,506 B1 10/2012 Holt
8,435,134 B2 5/2013 Tang et al.
8,480,512 B2 7/2013 Oldknow et al.
8,485,918 B2 7/2013 Roach et al.
8,491,412 B2 7/2013 Roach et al.
8,608,587 B2 12/2013 Henrikson et al.
8,632,419 B2 1/2014 Tang et al.
8,641,555 B2 2/2014 Stites et al.
8,663,026 B2 3/2014 Blowers et al.
8,678,946 B2 3/2014 Boyd et al.
8,777,773 B2 7/2014 Burnett et al.
8,845,453 B1 * 9/2014 Ehlers ..... A63B 60/00 473/327
8,858,361 B2 10/2014 Ripp et al.
8,864,601 B1 10/2014 Ehlers
8,888,604 B2 11/2014 Davenport
8,979,670 B2 3/2015 Aguayo et al.
8,992,338 B2 3/2015 Willett et al.
9,079,079 B2 7/2015 Fossum et al.
9,089,746 B2 7/2015 Schweigert
9,211,459 B2 12/2015 Nakamura
9,308,422 B2 4/2016 Ripp et al.
9,539,477 B2 * 1/2017 Ripp ..... A63B 53/047
9,561,413 B2 * 2/2017 Nielson ..... A63B 53/06
10,343,034 B2 * 7/2019 Henrikson ..... A63B 53/0466
2002/0077165 A1 6/2002 Bansemer et al.
2003/0153397 A1 8/2003 Roach et al.
2003/0220154 A1 11/2003 Anelli
2004/0157677 A1 8/2004 Roach et al.
2005/0272522 A1 12/2005 Chen et al.
2009/0123715 A1 5/2009 Qureshi
2009/0130372 A1 5/2009 Fukui et al.
2009/0318245 A1 12/2009 Yim et al.
2010/0016095 A1 1/2010 Burnett et al.
2013/0029780 A1 1/2013 Beno et al.
2013/0035705 A1 2/2013 Fath et al.
2013/0109494 A1 5/2013 Henrikson et al.
2013/0109498 A1 5/2013 Ban et al.
2013/0260927 A1 10/2013 Thurman et al.
2013/0274030 A1 10/2013 Roach et al.
2013/0297064 A1 11/2013 Sherbrooke et al.
2014/0206472 A1 7/2014 Aguayo et al.
2014/0323236 A1 10/2014 Burnett et al.
2015/0045142 A1 2/2015 Moreira et al.
2016/0166891 A1 6/2016 Narita et al.
2016/0213985 A1 7/2016 Jenson et al.
2017/0065859 A1 3/2017 Henrikson et al.
2017/0087425 A1 * 3/2017 Ripp ..... A63B 53/047
2017/0333766 A1 * 11/2017 Ban ..... A63B 53/0466
2018/0001163 A1 * 1/2018 Becktor ..... A63B 53/007

OTHER PUBLICATIONS

Pan, 2014, Multitool and Multi-Axis Computer Numerically Controlled Accumulation for Fabricating Conformal Features on Curved Surfaces, J Man Sci Eng 136:031007-1-14.

* cited by examiner

GOLF CLUB WITH AERODYNAMIC FEATURES ON CLUB FACE

CROSS-REFERENCE TO RELATED APPLICATIONS

This application is a continuation of U.S. patent application Ser. No. 15/618,414, filed Jun. 9, 2017, which is a continuation-in-part of U.S. patent application Ser. No. 15/409,114, filed Jan. 18, 2017, which claims priority to U.S. provisional patent application Ser. No. 62/445,965, filed Jan. 13, 2017, which applications are incorporated by reference.

FIELD OF THE INVENTION

The disclosure relates to golf clubs.

BACKGROUND

When a golfer makes a shot, he or she typically wants the golf ball to travel a certain distance in a certain direction. Unfortunately, when a golfer makes a shot, the ball will sometimes travel in an unintended direction or not travel the desired distance. Existing approaches to correcting for off-center shots or tuning distance have included designing a club's mass distribution to increase moment of inertia or locate a club head center of gravity with specificity. However, these approaches are limited by the other demands on a club head.

To help the ball fly straight, in the intended direction, golf clubs are given large heads with large faces. These golf club heads have a rotational moment of inertia that resists twisting, which helps keep the club head, and thus the golf ball, moving in a straight line. However, an undesirable consequence of increasing the size of the club head and of the face in particular is that it increases air drag as the head moves the air. Increased drag makes it more difficult to swing the club with the desired speed, resulting in a shot that travels a shorter distance than desired. Consequently, large club heads may lead to improved aim at the expense of shot distance and result in even greater frustration for the player.

SUMMARY

The disclosure relates to golf club heads with milled faces that have aerodynamic features that disrupt air flow over the club head when the club is swung, resulting in reduced drag. Because the aerodynamic features, which may include protrusions or indentations, are created by milling a curved surface, they can be incorporated into the face of a wood-type club head. When the club head is swung, the features interrupt laminar flow of the layer of air that travels away from the center point of the face. Consequently, as that boundary layer flows past the face and over the crown and sole of the club head, the boundary layer separates from the crown and sole at a point closer to the rear of the club head, resulting in less aerodynamic drag.

Due to the presence of the aerodynamic features on the face, the club heads described herein have advantages over existing designs. Because the features reduce drag, more of the force of the golfer's swing serves to accelerate the club head. Thus, the golfer achieves greater club head speed to produce longer shots.

In one aspect, the invention provides a golf club head with an aerodynamic feature. The club head includes a ball-striking face with a milled surface, a crown extending back from the face when the club head is at address, a sole extending back from the face to meet the crown, a hosel extending upwards from a heel side of the club head, and one or more aerodynamic features on the face. The aerodynamic features define an indentation or protrusion relative to an adjacent portion of the face and have a relief measurable along an axis orthogonal to the face.

When the golf club head is swung, the aerodynamic features disrupt air flow over the club head, resulting in reduced drag. Preferably, the aerodynamic features disrupt laminar air flow away from a center point of the face. Consequently, when the club head is swung, separation of the boundary layer occurs at a point farther from the face and closer to the rear along the front-rear axis than it would for an otherwise identical club head that lacks the aerodynamic features.

The club head may be solid or hollow. Preferably, the golf club head is a hollow, wood-type club head, such as the head for a driver or hybrid club. Thus, face of the club head may have a bulge radius, a roll radius, or both. The aerodynamic features may be integral with the material of the club face. The club head may have a loft angle of less than 20° when the head is at address. Alternatively, the club head may a loft angle of greater than 20° when the head is at address.

The aerodynamic features may be arc-shaped when viewed from an axis orthogonal to the face. The arc-shaped features may be positioned concentrically about a center point of the face. The arc-shaped features may be positioned symmetrically about a center point of the face. The separation distance between adjacent aerodynamic features may increase or decrease at increasing radial distances from the center point.

The aerodynamic features may have a cross-sectional shape that includes a wall surface proximal to the center point and substantially orthogonal to the face and a ramped surface distal to the center point that intersects with the wall surface at an acute angle. The aerodynamic features may have a cross-sectional shape that includes a curved peak, a curved trough, or both. The aerodynamic features may have a cross-sectional shape that resembles a sawtooth wave, a sinusoidal wave, a square wave, or a triangle wave.

The aerodynamic features may extend from the top edge of the face to the bottom edge of the face. The aerodynamic features may be absent from the central region of the face. Alternatively, the aerodynamic features may be absent from the edge of the face. For example, the aerodynamic features may extend no more than at least 0.25 inches, at least 0.5 inches, at least 0.75 inches, or at least 1 inches from the edge.

The relief of the aerodynamic features may be uniform across the face. Alternatively, the relief may vary across the club face. For example, the relief may increase or decrease at increasing radial distances from the center point.

The disclosure also provides club heads with faces that have a central region that has symmetrical roughness about a center point. The roughness includes indentations or protrusions created by milling a curved surface, such as the face of a wood-type club head. In a wood-type club head, which has a low loft angle, roughness decreases spin and increases distance when the ball is struck. The presence of a central region with symmetrical roughness on the face of a wood-type club head ensures that a ball that contacts the central region releases from the face uniformly to achieve minimum spin and maximum distance. In addition, by milling the club face, the dimensions of the indentations or protrusions can be precisely controlled to achieve the maximum level of roughness that complies with USGA regulations.

Club heads that have symmetrical roughness about the center of the face provide more uniformity to the interaction between the ball and face when the ball contacts the central, ball-striking region. Because the impact of the golfer's swing is transferred more evenly to the entirety of the ball, less spin is imparted to the ball, so it travels straighter and farther.

Aspects of the invention provide a golf club head that includes a ball-striking face, a crown extending back from the face when the club head is at address, a sole extending back from the face to meet the crown, a hosel extending upwards from a heel side of the club head, and a symmetrical pattern of surface roughness located on the central region of the face. The pattern of surface roughness may have any degree of symmetry about a center point of the face, such as 2-fold, 3-fold, 4-fold, 6-fold, or 8-fold symmetry. The roughness may include circular surface features or surface features arranged in concentric arcs.

The pattern may include indentations or protrusions relative to an adjacent portion of the face. The indentations or protrusions may have a relief measurable along an axis orthogonal to the face. The relief of the pattern of roughness may have any mean value and any maximum value.

The club heads with symmetrical roughness in the central region may also have peripheral region of the face that is smooth or has surface features arranged in a pattern different from the pattern of the central region. For example, the surface features in the peripheral region may be linear and extend radially outward from the center point when viewed from an axis orthogonal to the face.

The golf club heads with symmetrical roughness in the central region of the face may have any of the characteristics described above in relation to club heads with aerodynamic features.

DETAILED DESCRIPTION

Provided herein are golf club heads with faces milled to provide aerodynamic features that reduce drag during a swing to allow greater club head speed, resulting in longer shots. Protrusions or indentations on the face of the club head may reduce aerodynamic drag. The invention provides for the use of computer numerical control (CNC) milling to allow greater precision in making structural features on the curved faces of club heads, such as the faces on hollow, wood-type club heads. Consequently, aerodynamic features can be placed in any position on the club face to permit optimized drag reduction. Thus, the club heads of the invention display improved aerodynamic properties that lead to faster swinging and longer, more consistent shots for golfers.

The flow of air around a club head may be described in terms of how laminar or turbulent it is. One factor used in aerodynamics to characterize such properties of flow is the Reynolds number, which is the ratio of inertial forces to viscous forces. Within a fluid exhibiting internal movement at multiple velocities (such as where a fluid is moving relative to an abutting surface of a golf club head and there exhibiting a gradient velocity profile, in what is known as a boundary layer), the internal movement generates friction that contributes to turbulent flow. In contrast, increasing viscosity of the fluid inhibits turbulence. The Reynolds number quantifies forces associated with both the inertia of internal movement and the viscosity. Laminar flow occurs at low Reynolds numbers with dominant viscous forces, whereas turbulent flow occurs at high Reynolds numbers.

Without being bound by any physical mechanism, it may be found that during a golf swing, air flow around a wood-type club head is characterized by a low Reynolds number. This favors laminar flow, which minimizes friction. The velocity profile associated with that flow is affected by adverse pressure gradients. As pressure changes over the surface, a laminar boundary layer will tend to separate from the surface.

Flow separation occurs when the boundary layer travels far enough against an adverse pressure gradient that the speed of the boundary layer relative to the object falls almost to zero. The flow detaches from the surface and exhibits eddies and vortices. Flow separation can result in increased drag associated with a pressure differential between the front and rear surfaces of the club head.

Figure 1:
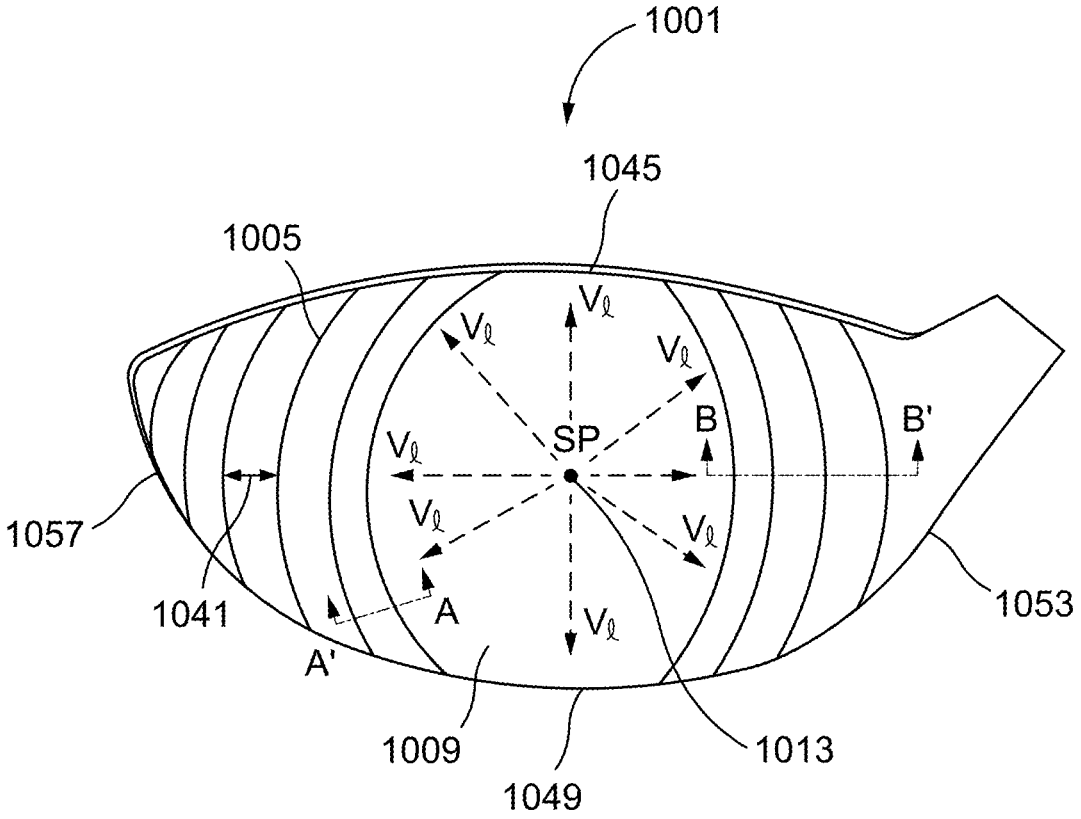
FIG. 1 illustrates a golf club head having aerodynamic features on its face according to an embodiment of the invention.

FIG. 1 illustrates a golf club head 1001 having aerodynamic features 1005 on the face 1009 according to an embodiment of the invention. When the club head 1001 is swung, a layer of air travels away from the center point 1013 across the face 1009. As the layer reaches the aerodynamic features 1005, its flow is disrupted, resulting in a switch from laminar flow to turbulent flow.

Figure 2:
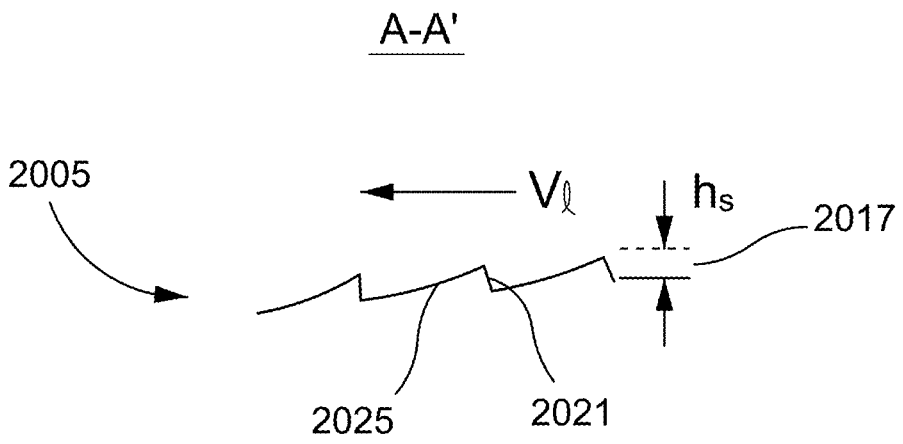
FIG. 2 shows a cross-sectional view of aerodynamic features along axis A-A' from FIG. 1 according to an embodiment of the invention.

FIG. 2 shows a cross-sectional view of aerodynamic features 2005 along axis A-A' according to an embodiment of the invention. As illustrated, the surface of the face 1009 is oriented upward, and the center of club head is beneath the face 1009. The aerodynamic features 2005 include indentations and/or protrusions relative to an adjacent portion of the face 1009. Each aerodynamic feature 2005 has a relief 2017 measurable along an axis orthogonal to the face 1009. The relief 2017 is measured as the length from the point most proximal to the center of the club head to the point most distal to the center of the club head. For aerodynamic features 2005 that include only protrusions, the point most proximal to the center of the club head is flush with adjacent portions of the club face, and the point most distal to the center of the club head appears raised. For aerodynamic features 2005 that include only indentations, the point most distal to the center of the club head is flush with adjacent portions of the club face, and the point most proximal to the center of the club head appears recessed. For aerodynamic features 2005 that include protrusions and indentations, the point most distal to the center of the club head appears raised, and the point most proximal to the center of the club head appears recessed. The aerodynamic features may have a relief of any value suitable for use on a club face.

The aerodynamic features 2005 have a sawtooth cross-sectional shape that includes (1) a wall surface 2021 proximal to the center point 1013 of the club face 1009 and substantially orthogonal to the face 1009 and (2) a ramped surface 2025 distal to the center point 1013 of the club face 1005. The wall surface 2021 and ramped surface 2025 meet an acute angle. A vector $v_1$ indicating the flow of air from the center point 1013 across the face 1009 is shown. The cross-sectional shape of the aerodynamic features 2005 is also described as forward-facing steps.

Figure 3:
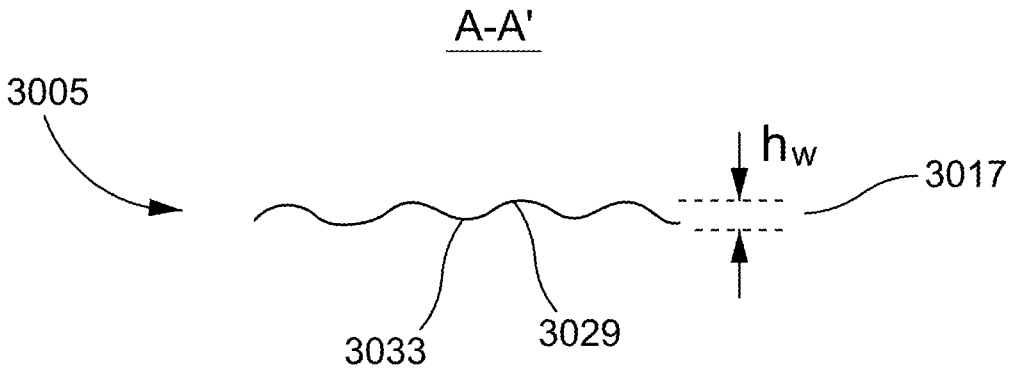
FIG. 3 shows a cross-sectional view of aerodynamic features along axis A-A' from FIG. 1 according to another embodiment of the invention.

FIG. 3 shows a cross-sectional view of aerodynamic features 3005 along axis A-A' according to another embodiment of the invention. As illustrated, the surface of the face 1009 is oriented upward, and the center of club head is beneath the face 1009.

The aerodynamic features 3005 have a sinusoidal cross-sectional shape that includes a curved peak 3029 and a curved valley 3033. In sinusoidal aerodynamic features 3005, the point most distal to the center of the club head is at the center of the curved peak 3029, and the point most proximal to the center of the club head is at the nadir of the curved valley 3033. Thus, the relief 3017 of sinusoidal aerodynamic features 3005 is measured from the center of the curved peak 3029 to the nadir of the curved valley 3033 along an axis orthogonal to the club face.

Preferably the club face 1009 is curved in a convex shape. When the club head is at address, the convex face has a roll measured along a vertical axis and a bulge measured along a horizontal axis. As described in detail in US 2013/0029780, which is incorporated by reference, the vertical roll of the club head can be defined as the value of a radius R at any given point along the ball striking face, as measured from a side view of the club head. The roll radius R can be a measurement, for example, of how the ball striking face is curving. For example, the roll radius R can be measured generally about a series of horizontal axes, the radius R indicating how the ball striking face is curving along a vertical direction from a crown to sole of club head about each of the horizontal axes. Thus, roll radius can be defined, for example, as it is defined in Werner and Greig, 'Optimum Face Curvature for Golf Clubs', Chapter 18 of How Golf Clubs Really Work, 2000, Origin, Inc., Jackson W Y, pp. 81-83. In an alternative embodiment, face curvature is defined with reference to a loft line normal to and passing through a geometric center of the strike face, a reference line through a club head center of gravity and parallel to the loft line, a measuring line on a surface of the strike face comprising a series of evenly spaced points, and N surface normals, each normal to and extending from the strike face at one of the points and each defining an angle with the next. Analogous measurements to determine curvature along a horizontal axis can be used to determine the bulge radius of the face.

It will be understood that aerodynamic features having other cross-sectional shapes and orientations are within the scope of the invention. For example and without limitation, the aerodynamic features may have cross-sectional shapes in the form of a sawtooth wave, a sinusoidal wave, a square wave, a triangle wave, an asymmetrical wave, forward-facing steps, rear-facing steps, or any irregularly shaped pattern.

Figure 4:
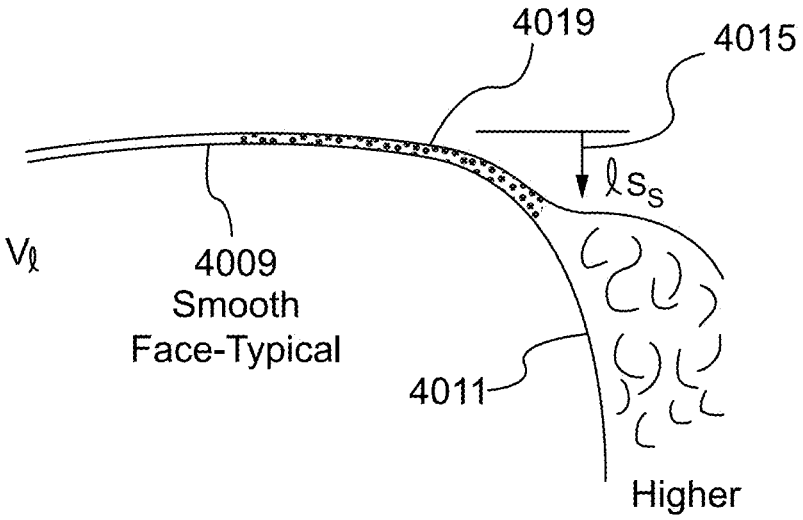
FIG. 4 PRIOR ART
FIG. 4 illustrates air flow over a prior art club head with a smooth face.

FIG. 4 illustrates air flow over a prior art club head with a smooth face. As illustrated, the face 4009 of the club is at the top and the crown 4011 is to the right. As described above, when a club head with a smooth face is swung through the air, airflow over the surface of the face initially forms a boundary layer that exhibits laminar flow. The air moves along a vector away from the stagnation point and toward an edge where the face 4009 meets the crown 4011 or sole. As the boundary layer 4019 passes from the face to the crown or sole, it separates from the club head. For a club head with a smooth face 4009, separation of the boundary 4019 layer occurs at a short distance 4015 from the face along the front-rear axis of the club head and at a short time interval during its travel across the club head. This early separation of the boundary layer 4019 produces high aerodynamic drag. As a result, much of the force of the golfer's swing is directed toward combating drag, and the velocity of the club head is compromised.

Figure 5:
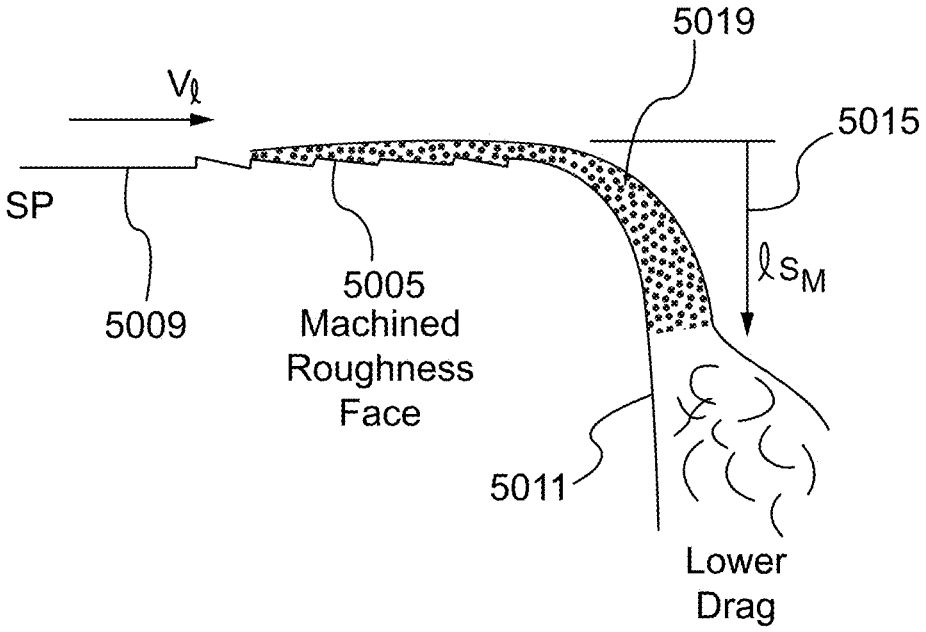
FIG. 5 illustrates air flow over a club head with aerodynamic features according to an embodiment of the invention.

FIG. 5 illustrates air flow over a club head with aerodynamic features 5005 according to an embodiment of the invention. As illustrated, the face 5009 of the club is at the top and the crown 5011 is to the right. When this club head is swung, the aerodynamic features 5005 on the face 5009 of the club head trip airflow across the face 5009 from laminar flow to turbulent flow before the boundary layer 5019 reaches the edge of the face 5009 and travels over the crown 5011 or sole. As indicated above, turbulent flow resists flow separation better than the laminar flow does, so separation of the boundary layer 5019 occurs at a greater distance 5015 from the face 5009 along the front-rear axis of the club head and at a longer time interval during its travel across the club head. This delayed separation of the boundary layer 5019 leads to reduced aerodynamic drag. Consequently, less of the force of the golfer's swing is used to counteract drag, resulting in higher velocity for the club head.

The aerodynamic features may be created by milling (also known as "machining") or etching the surface of the face. The face may be made of material suitable for milling and subsequent use in striking balls, such as titanium, steel, aluminum, carbon fiber, or scandium. The entire face, including the features, can be made from a single piece of metal or other material. Preferably, the face component is convex and suitable for the head of a hollow, wood-type club, such as a driver, fairway, or hybrid. Alternatively, the face component may be suitable for a driving iron and/or may be flat. Preferably, computer numerical control (CNC) milling is used to generate aerodynamic features with precise shapes and dimensions. To mill features that meet the desired requirements on a curved surface, such as the face of a wood-type club head, a multi-axis milling machine is used, such as a machine that has 4 axes, 5 axes, or more. The CNC machine may include multiple tools, such as drills and saws, in a single cell to mill the face component. Computer-aided design (CAD) software is used to define the dimensions of the aerodynamic features, and the dimensions are translated into manufacturing directives by computer-aided manufacturing (CAM) software. The directives are then transformed into specific commands for a CNC machine to produce the features on the surface of the component that will become the face of the club head. Methods and tools for using CAD and CAM software to perform CNC milling on curved surfaces, such as those required for the face of a wood-type club head, are described in detail in, for example, Pan, Y. et al., Multitool and Multi-Axis Computer Numerically Controlled Accumulation for Fabricating Conformal Features on Curved Surfaces, Journal of Manufacturing Science and Engineering, 136:031007 (June 2014); and US Publication No. 2013/0297064; each of which is incorporated by reference.

The aerodynamic features may have any arrangement on the face that facilitates tripping of the boundary layer. The aerodynamic features 1005 may have the shape of arcs when viewed from an axis orthogonal to the face 1009, and the arcs may be positioned concentrically about the center point 1013 of the face 1009. Alternatively, the aerodynamic features 1005 may appear circular or linear when viewed from an axis orthogonal to the face. Individual arc-shaped aerodynamic features 1005 are separated from each other by a distance 1041 measured radially from the center point 1013 of the face 1009. The distance 1041 between adjacent arc-shaped aerodynamic features 1005 may be uniform across the face 1009, or it may vary. Preferably, the distance 1041 between adjacent arc-shaped aerodynamic features 1005 increases at increasing radial distances from the center point 1013. Alternatively, the distance 1041 between adjacent arc-shaped aerodynamic features 1005 may decrease at increasing radial distances from the center point 1013.

The aerodynamic features 1005 may extend from the top edge 1045 to the bottom edge 1049 of the face 1009. Alternatively, the aerodynamic features 1005 may extend a portion of the distance from the top edge 1045 to the bottom edge 1049 of the face 1009 or from the heel edge 1053 to the toe edge 1057 of the face 1009 or a portion thereof.

The aerodynamic features 1005 may occupy a peripheral region of the face 1009 and be absent from the central region of the face 1009. Alternatively, the aerodynamic features may occupy the entire face, or they may occupy the central region of the face 1009 and be absent from a peripheral region of the face 1009. For example, the aerodynamic features may extend no more than at least 0.25 inches, at least 0.5 inches, at least 0.75 inches, or at least 1 inches from the edge of the face 1009. The relief of aerodynamic features across the face may be uniform, or it may vary. The relief of aerodynamic features may increase or decrease at increasing radial distances from the center point 1013 of the face 1009.

The golf club head 1001 having aerodynamic features 1005 on its face 1009 may be for any type of golf club. Preferably, the golf club head has a hollow, wood-type club head, such as a driver, fairway wood, or hybrid. The face of the golf club head may have a loft angle of less than 20° when the club head is address.

CNC milling can be used to create other types of features on curved surfaces of club heads according to embodiments of the invention. For example and without limitation, CNC-milled features may include grooves or punch marks in the impact area; decorative markings; windows for visualizing club settings; notches, slots or holes for accommodating extrinsic items, such as electronic chips or other devices; or register marks or complementary shapes that allow fitting of components of the club head.

The invention also provides club heads in which CNC milling is used to create faces that have high level of surface roughness that is symmetrical about a center point. In golf club heads with loft angles of less than 20°, such as hollow, wood-type club heads, increased surface roughness decreases spin on shots when the ball is struck by the face. This allows the golfer to shoot with greater aim and distance.

Making faces for wood-type clubs that have surface roughness resulting in decreased spin has been impractical using prior art manufacturing methods for several reasons. First, the United States Golf Association has strict rules that limit that mean surface roughness to 180 microinches and the maximum surface roughness to 1000 microinches, and non-milling techniques typically cannot achieve a maximum surface roughness of 1000 microinches without exceeding a mean surface roughness to 180 microinches. See US 2015/

0045142, incorporated by reference. In addition, non-milling techniques generally lack the precision to ensure that surface roughness is symmetrical about a center point, and asymmetric surface roughness does not result in decreased spin. On the other hand, prior the present invention, it has not been practical to mill curved surfaces, such as the face of a wood-type club head, on a scale required for the manufacture club heads.

By using CNC milling techniques suitable for curved surfaces of club heads, the present invention overcomes these limitations. Consequently, the invention provides wood-type club heads with faces that have symmetrical patterns of high roughness that conform to USGA rules.

Figure 6:
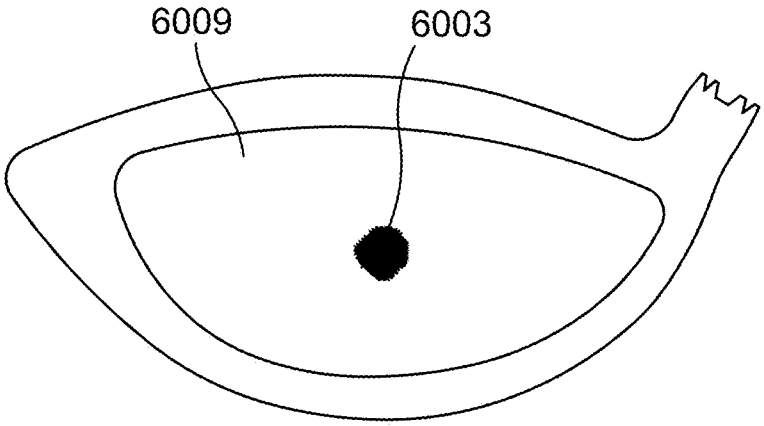
FIG. 6 is the first in a sequence of five drawings showing the contact area of a ball on the face of a club head at an initial point during impact.

FIG. 6 is the first in a sequence of five drawings showing the contact area 6003 of a ball on the face 6009 of a club head at an initial point during impact. The ball has just started to compress, and only a small portion of the ball contacts the face 6009. When the ball is properly aligned, the contact area 6003 just surrounds the center point of the face.

Figure 7:
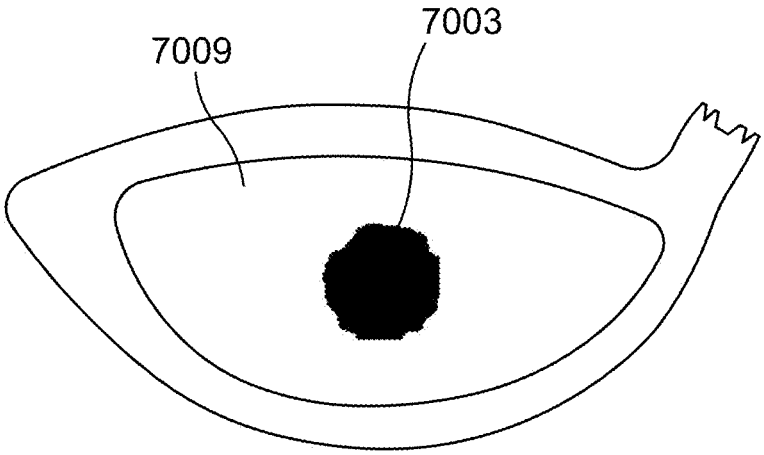
FIG. 7 is the second in a sequence of five drawings showing the contact area of a ball on the face of a club head at a second point during impact.

FIG. 7 is the second in a sequence of five drawings showing the contact area 7003 of a ball on the face 7009 of a club head at a second point during impact. The ball is in an intermediate state of compression, and the contact area 7003 has expanded to surround the center point in an essentially symmetrical manner.

Figure 8:
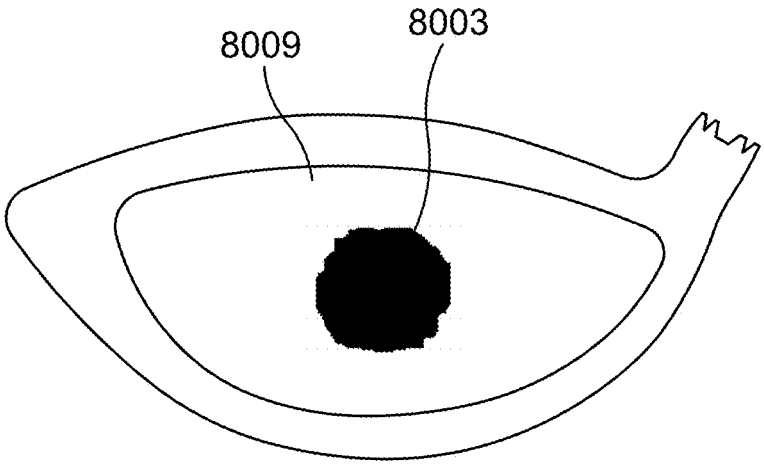
FIG. 8 is the third in a sequence of five drawings showing the contact area of a ball on the face of a club head at a third point during impact

FIG. 8 is the third in a sequence of five drawings showing the contact area 8003 of a ball on the face 8009 of a club head at a third point during impact. The ball is fully compressed, and the contact area 8003 has reached its maximum size.

Figure 9:
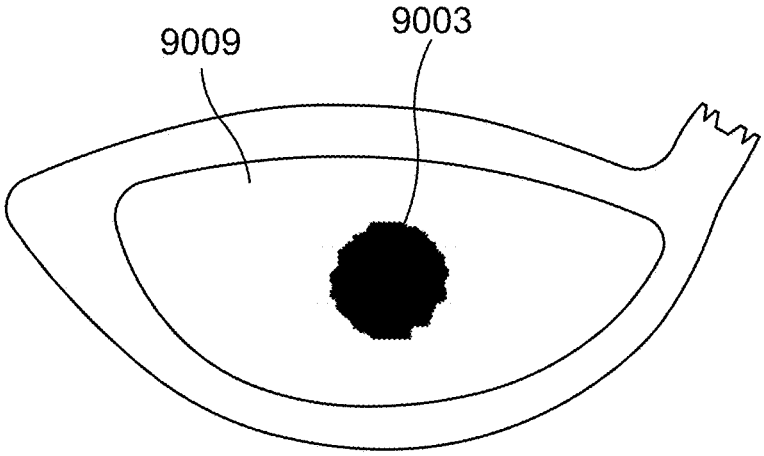
FIG. 9 is the fourth in a sequence of five drawings showing the contact area of a ball on the face of a club head at fourth point during impact.

FIG. 9 is the fourth in a sequence of five drawings showing the contact area 9003 of a ball on the face 9009 of a club head at fourth point during impact. The ball has started to decompress, and the contact area 9003 has begun to contract.

Figure 10:
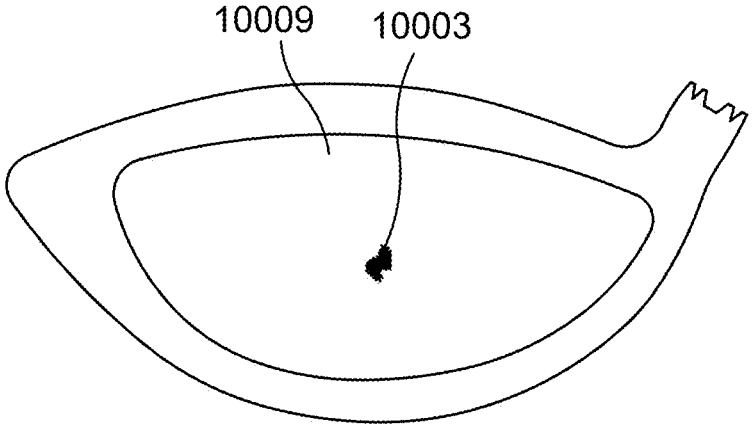
FIG. 10 is the fifth in a sequence of five drawings showing the contact area of a ball on the face of a club head at a final point during impact.

FIG. 10 is the fifth in a sequence of five drawings showing the contact area 10003 of a ball on the face 10009 of a club head at a final point during impact. The ball is nearly fully decompressed, and the contact area 10003 has reached its minimum size just before the ball leaves the face 10009.

Figure 11:
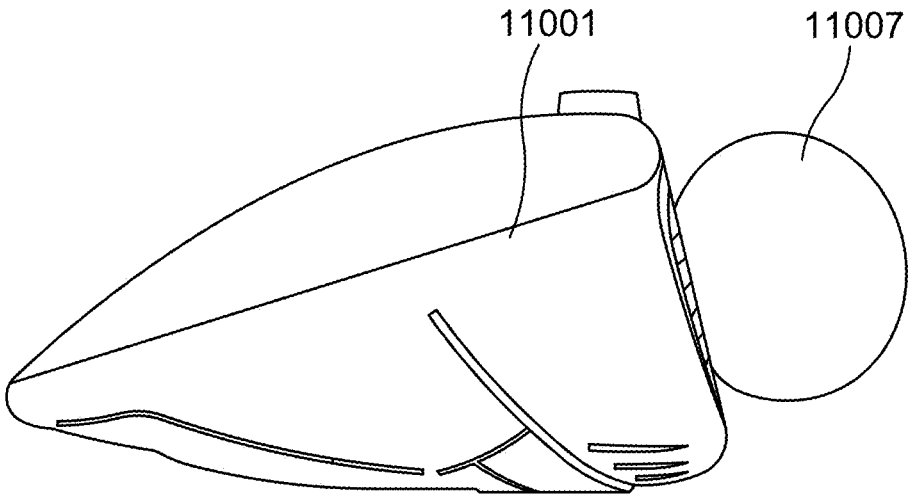
FIG. 11 is a drawing of a side view of a ball contacting the face of a club head near the midpoint of impact.

FIG. 11 is a drawing of a side view of a ball 11007 contacting the face of a club head 11001 near the midpoint of impact. The ball 11007 is fully compressed against the face.

Figure 12:
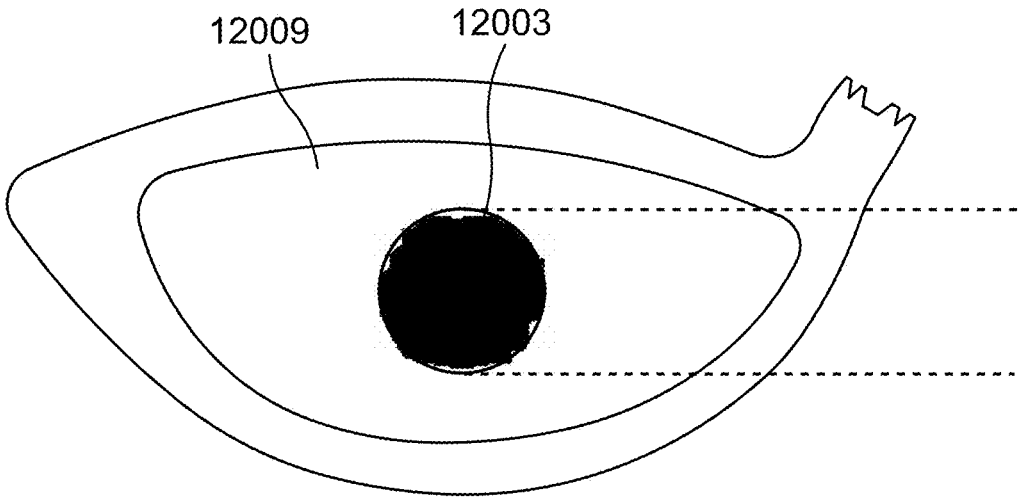
FIG. 12 is a drawing of a front view of the face of the club head from FIG. 11.

FIG. 12 is a drawing of a front view of the face 12009 of the club head from FIG. 11. The contact area 12003 of the ball is shown. The contact area 12003 is at its maximum size during mid-impact.

Figure 13:
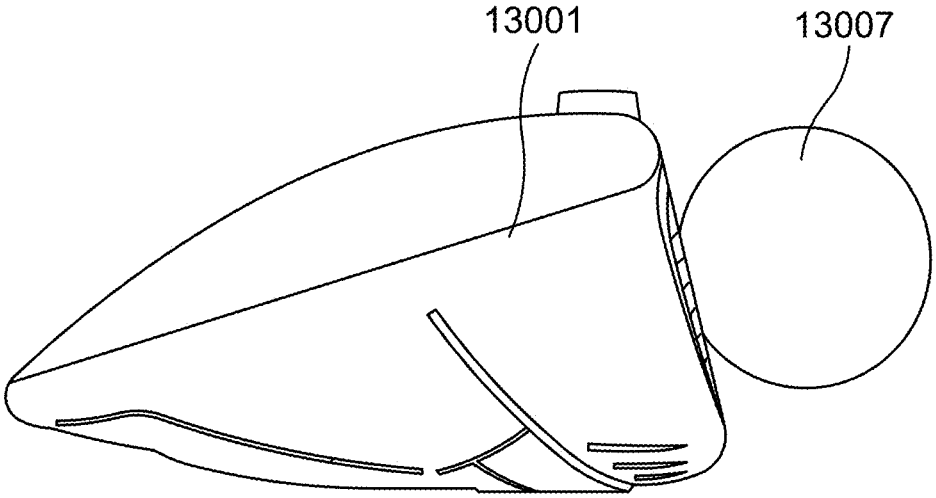
FIG. 13 is a drawing of a side view of a ball contacting the face of a club head at a late point during impact.

FIG. 13 is a drawing of a side view of a ball 13007 face of a club head 13001 at a late point in impact. The ball 13007 has begun to decompress before it leaves the face.

Figure 14:
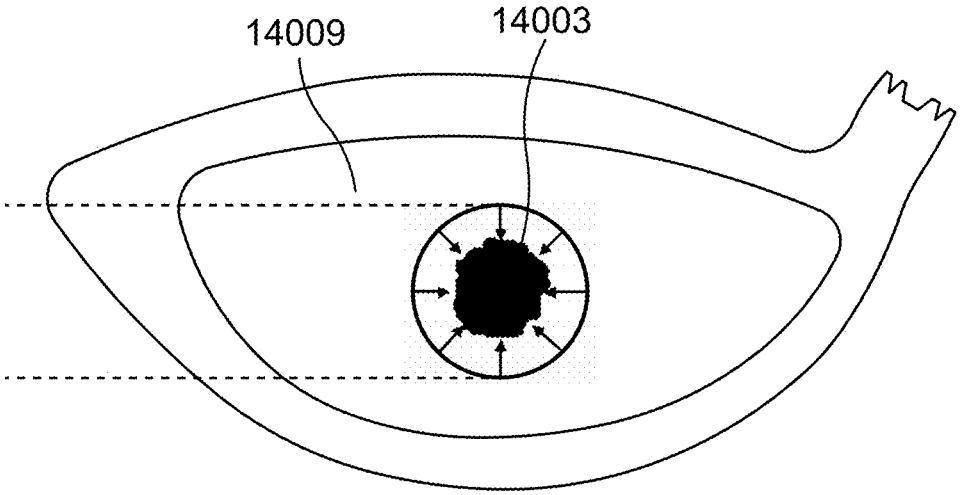
FIG. 14 is a drawing of a front view of the face of the club head from FIG. 13.

FIG. 14 is a drawing of a front view of the face 14009 of the club head from FIG. 13. The contact area 14003 of the ball is shown, and the circle shows the contact area 12003 from FIG. 12. The contact area 14003 has contracted essentially symmetrically about the center point of the face.

When the ball is aligned with the center of the club face during impact, the contact area shrinks with nearly 360° symmetry about the center point during the latter half of impact. Because surface roughness tends to decrease spin when a ball leaves the face of a wood-type club head, aim and distance are optimized when the surface roughness is symmetrical across the contact area. Thus, it is advantageous for the central region of the face of such a head to have surface roughness that is symmetrical about the center point.

Figure 15:
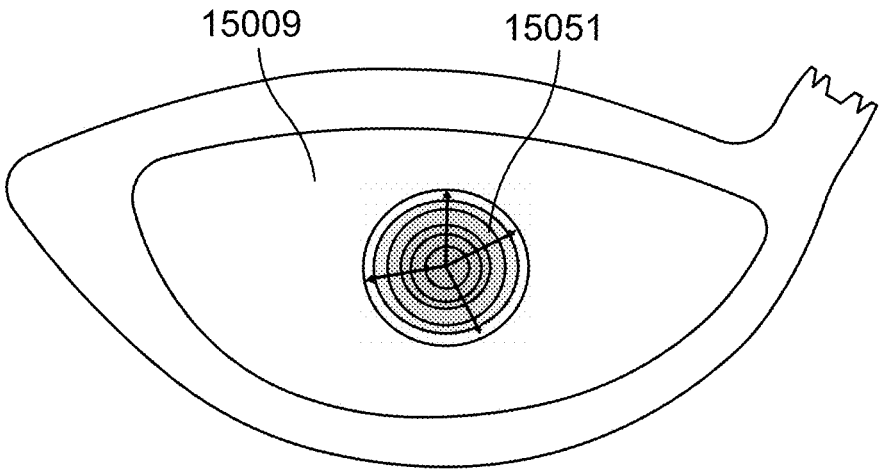
FIG. 15 is a drawing of a face having a central region that has 360° symmetry of surface roughness according to an embodiment of the invention.

FIG. 15 is a drawing of a face 15009 having a central region 15051 that has 360° symmetry of surface roughness according to an embodiment of the invention. The average surface roughness measured along any of the arrows extending radially from a center point of the face is identical. The 360°-symmetrical roughness is due to the presence of symmetrically arrayed structural features.

Figure 16:
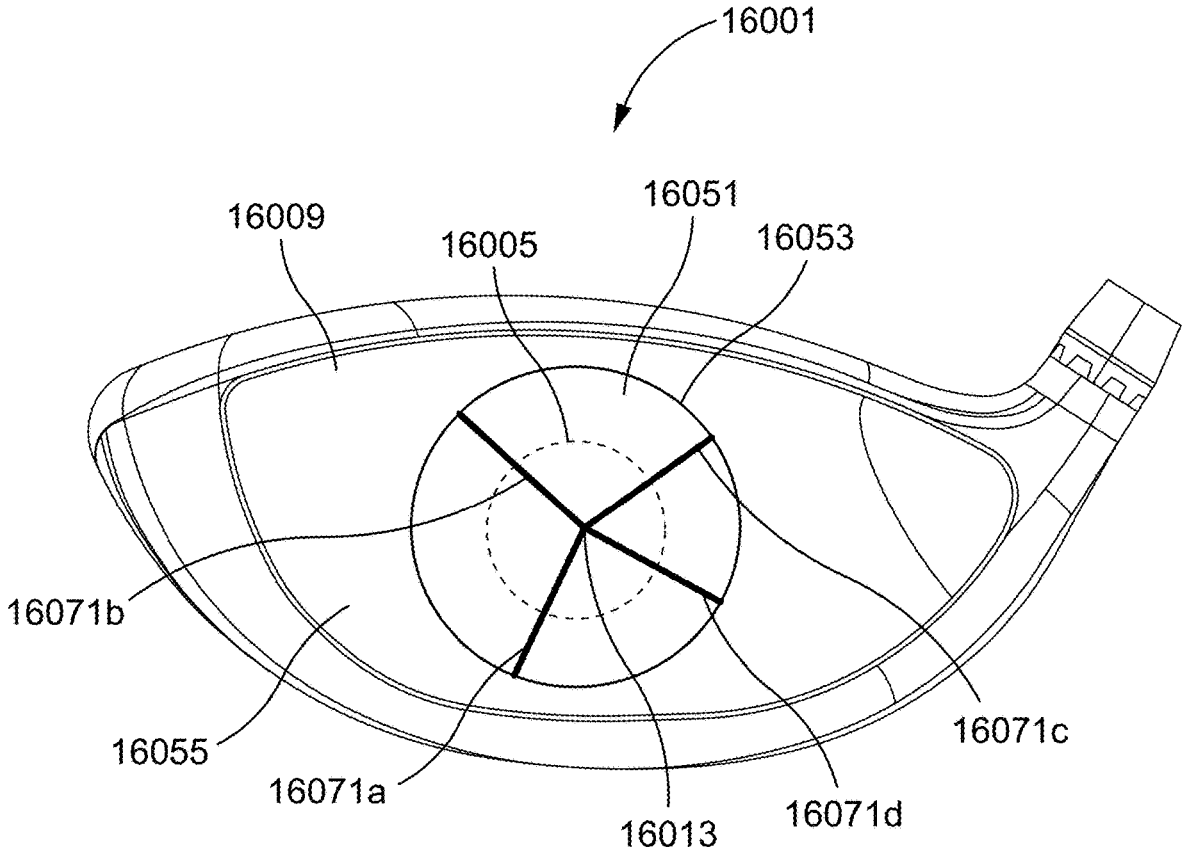
FIG. 16 shows a golf club head in which a central region of the face has a surface roughness that is symmetrical in 360° about the center point according to an embodiment of the invention.

FIG. 16 shows a golf club head 16001 in which a central region 16051 of the face 16009 has a surface roughness that is symmetrical in 360° about the center point 16013 according to an embodiment of the invention. As illustrated, the central region 16051 is bounded by a perimeter 16053 and includes a series of structural features 16005 arranged in concentric circles around the center point. However, the structural features may form a pattern that has <360° symmetry, such as 2-fold, 3-fold, 4-fold, 6-fold, or 8-fold, 12-fold, 16-fold, or 24-fold symmetry. The structural features 16005 may have any cross-sectional shape as described above for the aerodynamic features, including but not limited to, a sawtooth wave, a sinusoidal wave, a square wave, a triangle wave, an asymmetrical wave, forward-facing steps, rear-facing steps, or any irregularly shaped pattern. The structural features may be uniformly spaced, as illustrated, or variably spaced. For example, the distance between structural features may increase or decrease at increasing radial distances from the center point.

Average (mean) surface roughness and maximum surface roughness were measured along radial strips 16071*a*-16071*d* of the central region 16051. Values are shown in Table 1.

TABLE 1

Surface roughness of radial strips

| Radial strip | Maximum relief (microinches) | Mean relief (microinches) |
|---|---|---|
| 16071a | 785 | 129 |
| 16071b | 743 | 137 |
| 16071c | 820 | 139 |
| 16071d | 722 | 123 |

Figure 17:
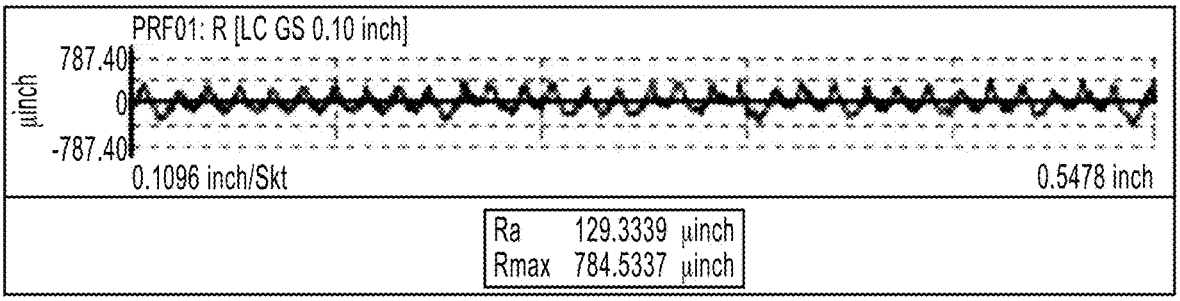
FIG. 17 is a trace of the surface roughness along a first radial strip of the central region of the face of the club head from FIG. 16.

FIG. 17 is a trace of the surface roughness along a first radial strip 16071*a* of the central region 16051 of the face. Roughness was measured from the center point 16013 to a point on the perimeter 16053 adjacent to the lower toe area.

Figure 18:
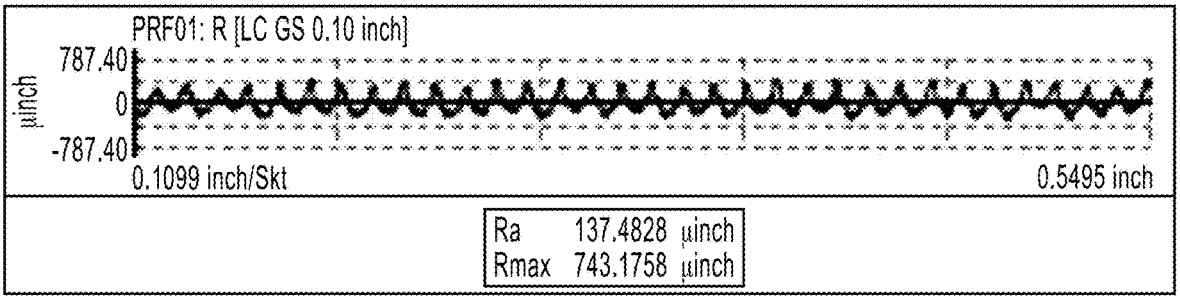
FIG. 18 is a trace of the surface roughness along a second radial strip of the central region of the face of the club head from FIG. 16.

FIG. 18 is a trace of the surface roughness along a second radial strip 16071*b* of the central region 16051 of the face. Roughness was measured from the center point 16013 to a point on the perimeter 16053 adjacent to the upper toe area.

Figure 19:
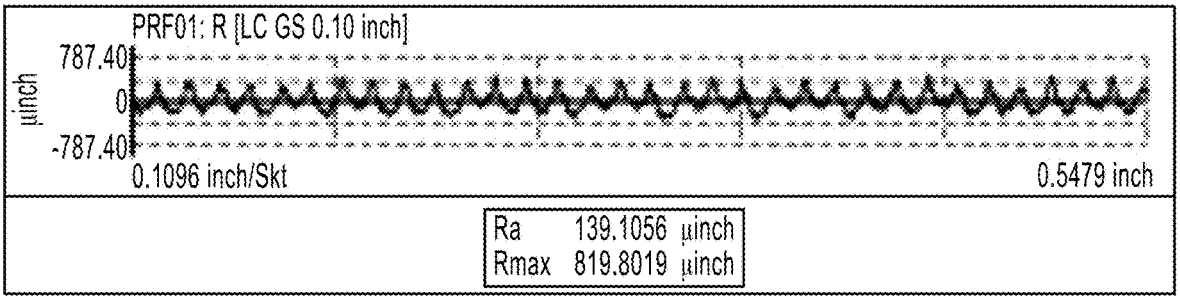
FIG. 19 is a trace of the surface roughness along a third radial strip of the central region of the face of the club head from FIG. 16.

FIG. 19 is a trace of the surface roughness along a third radial strip 16071*c* of the central region 16051 of the face. Roughness was measured from the center point 16013 to a point on the perimeter 16053 adjacent to the upper heel area.

Figure 20:
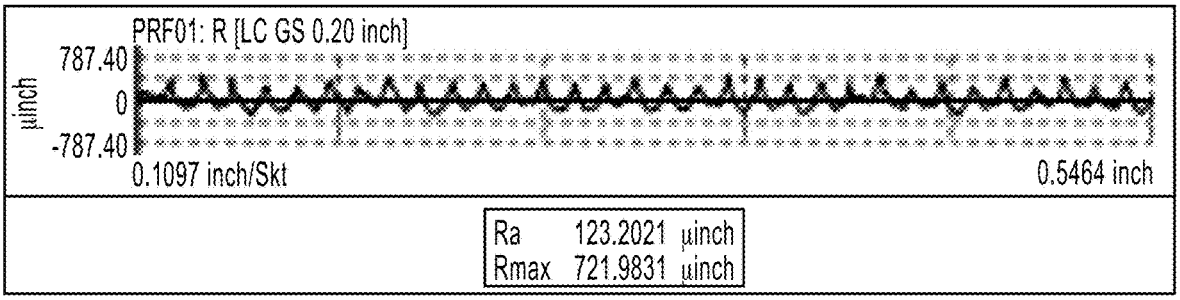
FIG. 20 is a trace of the surface roughness along a fourth radial strip of the central region of the face of the club head from FIG. 16.

FIG. 20 is a trace of the surface roughness along a fourth radial strip 16071*d* of the central region 16051 of the face. Roughness was measured from the center point 16013 to a point on the perimeter 16053 adjacent to the lower heel area.

The surface roughness of the central region is determined by the relief of the structural features. Preferably, the structural features are milled so that the relief of the features complies with United States Golf Association (USGA) rules on surface roughness for club faces. The USGA prescribes an average surface roughness of not greater than 180 microinches and a maximum crest-to-trough depth of not greater than 1000 microinches. Thus, the surface features across the club face may have a mean relief of about 100 microinches, about 110 microinches, about 120 microinches, about 130 microinches, about 140 microinches, about 150 microinches, about 160 microinches, about 170 microinches, about 180 microinches, from about 100 microinches to about 180 microinches, from about 120 microinches to about 180 microinches, from about 120 microinches to about 150 microinches, or from about 150 microinches to about 180 microinches. The surface features may have a maximum relief of about 600 microinches, about 700 microinches, about 800 microinches, about 900 microinches, about 1000 microinches, from about 600 microinches to about 1000 microinches, from about 700 microinches to about 1000 microinches, from about 800 microinches to about 1000 microinches, or from about 900 microinches to about 1000 microinches. The structural features may have uniform dimensions, or they may have variable dimensions. For example, the relief of the structural features may increase or decrease at increasing radial distances from the center point.

The face 16009 may include a peripheral region 16055 that has structural features arranged in a different pattern from the structural features 16005 in the central region 16051. The structural features in the peripheral region 16055 may have 360° symmetry about the center point. Alternatively, they may have <360° symmetry or may be asymmetric. The structural features in the peripheral region 16055 may extend radially outward from the center point of the face.

Figure 21:
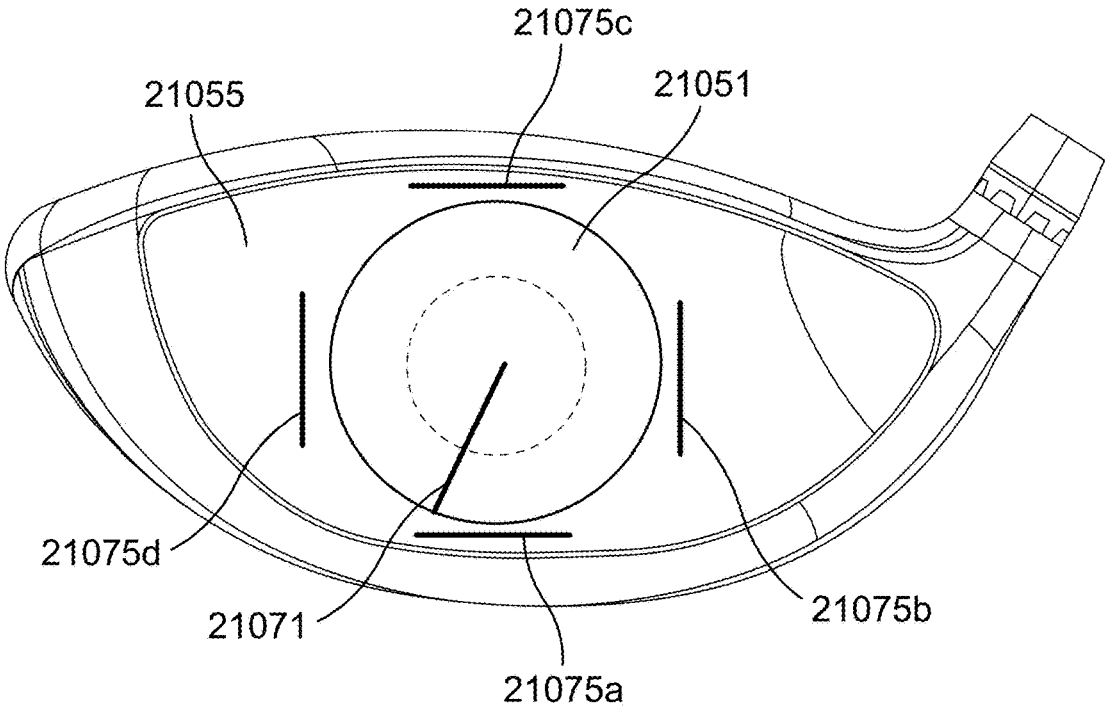
FIG. 21 shows a golf club head in which a peripheral region of the face has a different pattern of surface roughness from the central region according to an embodiment of the invention.

FIG. 21 shows a golf club head in which a peripheral region 21055 of the face has a different pattern of surface roughness from the central region 21051 according to an embodiment of the invention. Average (mean) surface roughness and maximum surface roughness were measured along strips 21075*a*-21075*d* in the peripheral region 21055 and along radial strip 21071 of the central region 21051. Values are shown in Table 2.

TABLE 2

Surface roughness of radial strips

| Strip | Maximum relief (microinches) | Mean relief (microinches) |
|---|---|---|
| 21075a | 652 | 99 |
| 21075b | 841 | 127 |
| 21075c | 660 | 99 |
| 21075d | 418 | 60 |
| 21071 | 878 | 141 |

Figure 22:
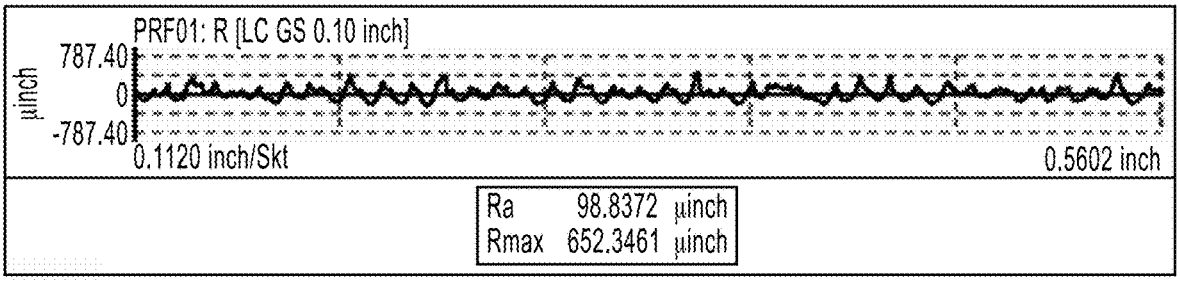
FIG. 22 is a trace of the surface roughness along a first strip of the peripheral region of the face of the club head from FIG. 21.

FIG. 22 is a trace of the surface roughness along a first strip 21075*a* of the peripheral region 21055 of the face. Roughness was measured from a point on the toe-adjacent end of strip 21075*a* to a point on the heel-adjacent end of strip 21075*a*.

Figure 23:
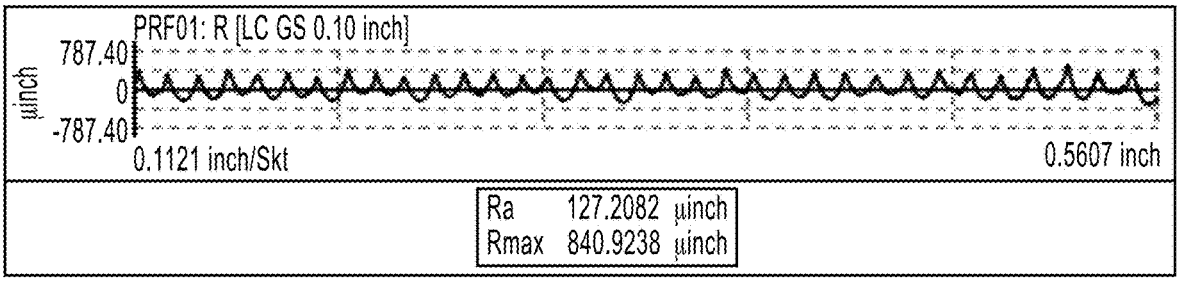
FIG. 23 is a trace of the surface roughness along a second strip of the peripheral region of the face of the club head from FIG. 21.

FIG. 23 is a trace of the surface roughness along a second strip 21075*b* of the peripheral region 21055 of the face. Roughness was measured from a point on the crown-adjacent end of strip 21075*b* to a point on the sole-adjacent end of strip 21075*b*.

Figure 24:
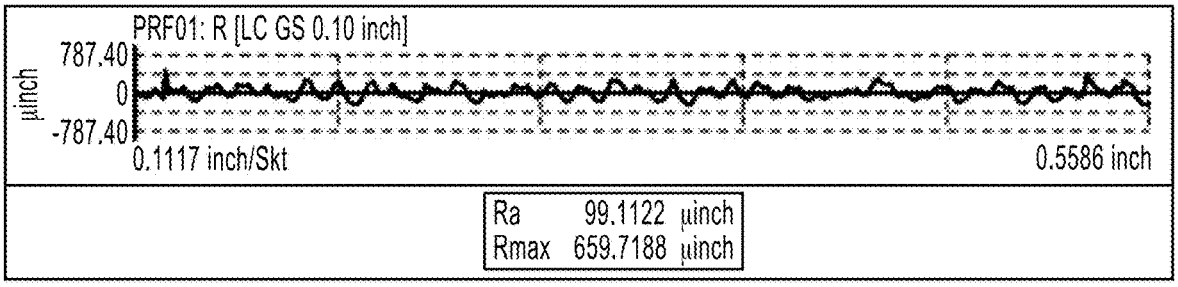
FIG. 24 is a trace of the surface roughness along a third strip of the peripheral region of the face of the club head from FIG. 21.

FIG. 24 is a trace of the surface roughness along a third strip 21075*c* of the peripheral region 21055 of the face. Roughness was measured from a point on the toe-adjacent end of strip 21075*c* to a point on the heel-adjacent end of strip 21075*c*.

Figure 25:
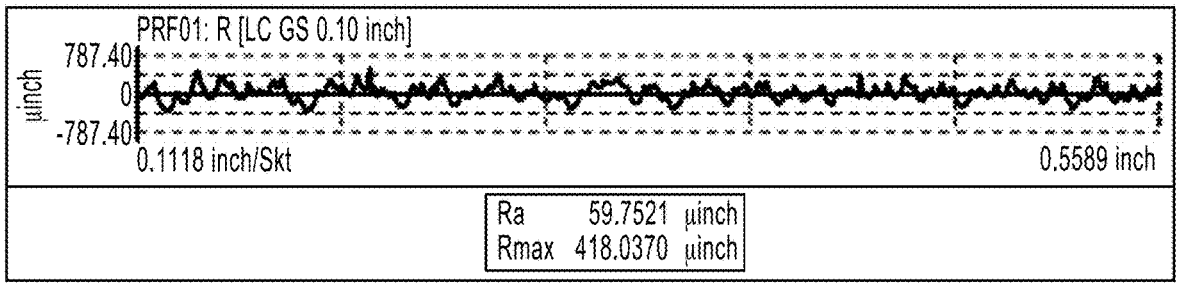
FIG. 25 is a trace of the surface roughness along a fourth strip of the peripheral region of the face of the club head from FIG. 21.

FIG. 25 is a trace of the surface roughness along a fourth strip 21075*d* of the peripheral region 21055 of the face. Roughness was measured from a point on the crown-adjacent end of strip 21075*d* to a point on the sole-adjacent end of strip 21075*d*.

Figure 26:
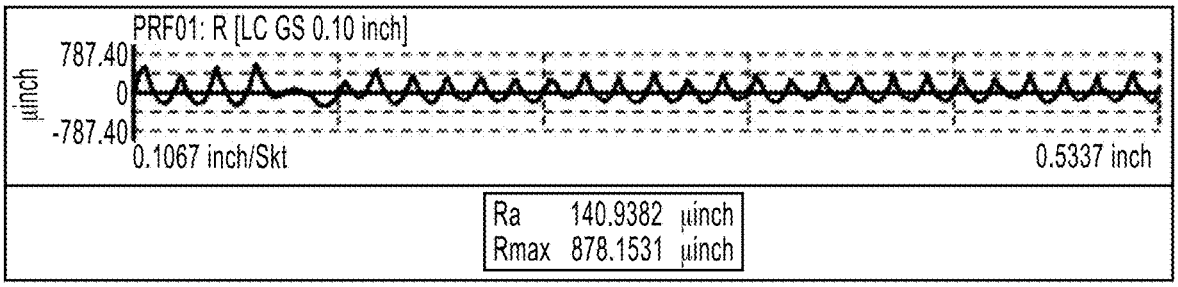
FIG. 26 is a trace of the surface roughness along a radial strip of the central region of the face of the club head from FIG. 21.

FIG. 26 is a trace of the surface roughness along a radial strip 21071 of the central region 21051 of the face. Roughness was measured from the center point 16013 to a point on the perimeter 16053 adjacent to the lower toe area.

The invention also includes aerodynamic boundary layer trips that are provided by a lightweight material such as polyurethane applied to a club head after casting, during assembly and finishing. The lightweight material can be, for example, a polyurethane and can be formed by laser-cutting. Because the material is applied to the club head after casting the metal club head body, it is not required to cast complex 3D features such as the described trip members that may be difficult or impossible to cast. Because the trip members are provided by a lightweight material, they do not otherwise compromise mass distribution of the club head. Thus a club head of the present invention includes lightweight trip members on the surface. While the club head is swung through the air, airflow over the surface of the club head initially forms a boundary layer exhibiting laminar flow. When the boundary layer encounters the trip members, the trip members trip the laminar flow into turbulent flow. The turbulent flow resists flow separation better than the laminar flow does. Since flow separation is associated with strong aerodynamic drag, a club head with trip members avoids aerodynamic drag and flies through the air very rapidly, which causes a golf ball, when struck, to gain great momentum and travel a great distance.

Figure 27:
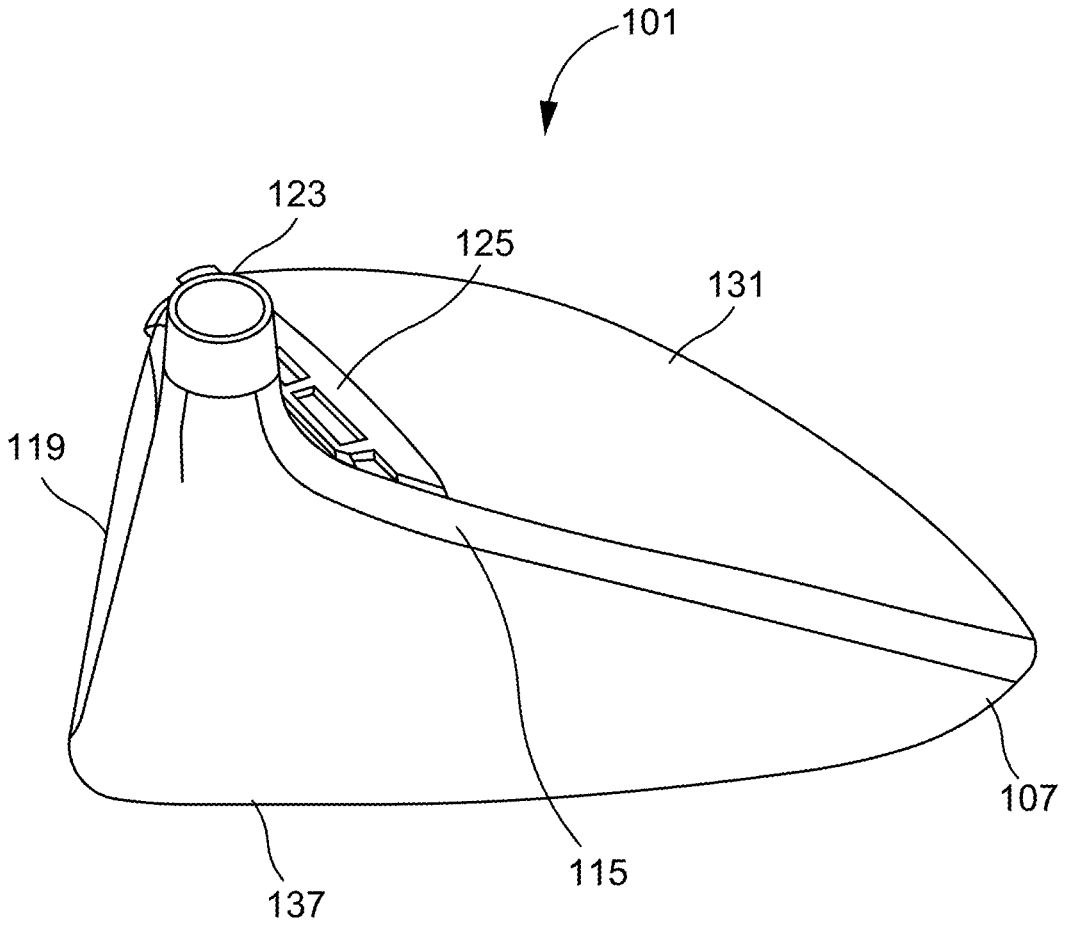
FIG. 27 shows a golf club head that includes a trip member.

FIG. 27 shows a golf club head 101 that includes a club head body 107 with a heel portion 115 and a toe portion 171, a ball-striking face 119 on a front of the club head body, a hosel 123 extending upwards from the heel portion 115 of the club head body 107, and a trip member 125 adhered to the club head body. The club head 101 preferably includes a crown 131 and a sole 137 extending back from the ball striking face 119, the crown 131 meeting the sole 137 or a skirt at the heel portion, the toe portion 171, and an aft portion of the club head body. The trip member 125 may be provided by any suitable area with relief. For example, the trip member 125 may include one or more pieces of a polymer adhered to the club head.

The inclusion of a trip member 125 addresses a problem by which aerodynamic drag impedes the motion of a club head through air. In particular, a driver with a club head volume approaching 460 cc induces more drag than older, smaller heads. The trip member 125 smooths the air wake over the club head body and, in turn, reduces drag for improved aerodynamics. For additional background, see U.S. Pat. Nos. 8,608,587; 7,988,565; U.S. Pub. 2013/0260927; and U.S. Pub 2003/0220154, all incorporated by reference. Adding a trip member to a cast metal (titanium) part can incur penalties. One penalty is that if a trip member is cast as part of a cast part, the trip member adds mass in a sub-optimal location, interfering with the club head's otherwise intended CG/MOI. Another penalty of a cast-in trip member is the added complexity of the manufacturing process which increases tool costs and reject rate. Also, due to the casting tolerances and techniques, cast-in trip members are greatly limited in placement and quantity, so much so that function of cast-in trip members is far from optimized.

To address penalties that would accompany cast-in trip members, the invention provides trip members that are applied to club head after the club head is cast. Typically, a club head is cast, painted with colored paint, finished with a clear coat, and baked. Trip members may be at various post-casting stages in the manufacturing process. For example, trip members may be added between the casting and painting steps, between the painting and finishing steps, between the finishing and baking steps, or after the baking step. The added trip members are composed of a material that does not have the same negative CG/MOI weight penalties of a cast-in trip member. Trip members of the invention thus provide truly optimized aerodynamic function for any player type.

Preferably, trip members are made of plastic, such as thermoplastic polyurethane (TPU), acrylonitrile butadiene styrene (ABS), or polycarbonate (PC). Alternatively, trip members may be made of other durable, lightweight materials, such as carbon fiber and aluminum.

By creating the aero trips out of a light or flexible material such as polyurethane, methods and devices of the invention (i) save weight due to having lower density than club head metal, (ii) eliminate the manufacturing penalties associated with cast-in trips, and (iii) ensure optimized aerodynamic function for a variety of attack angles. The trip members may be die-cut or laser-cut to exacting size or shape and applied after the head has been painted. Thus, the club head body has a first material having a first density and the trip member has a second material having a second density lower than the first density. For example, the club head body may include titanium ($\delta \approx 4.5$ g/cm$^3$) and the trip members may include polyurethane ($\delta \approx 1.2$ g/cm$^3$).

The trip member may be a three-dimensional (3D) decal that imparts functionality to the club head. For example, the 3D decal may alter the aerodynamic properties of the club head, or it may perform one of the functions described below.

According to some embodiments, the 3D features can be used to secure electronic devices to a golf club. For example, the inclusion of an electronic device in the club head enables the club to detect and record information about a user's swing or the impact between the club head and the golf ball. The electronic device or sensor can detect and record variables such as club head velocity, acceleration, striking force, momentum, striking angle, ball spin, and the like. Therefore, the lightweight material, e.g., thermoplastic polyurethane (TPU), may be formed into features that secure one or more electronic devices to the club head. For example and without limitation, the electronic device may be a radio-frequency identification device, an antenna, an accelerometer, a piezoelectric sensor, a microchip, a battery, or conducting wire. Depending on the type of device and the nature of the information to be recorded, the electronic device can be positioned on the crown, sole, ball-striking face, or hosel.

An electronic device in the club head may be in electrical communication with another electronic device positioned on the club shaft. For example, information detected and recorded by the device in the club head can be communicated to another device in the shaft that displays the information to the user or transmits the information to an external receiver, such as a hand-held electronic device or cellular phone. Thus, the thermoplastic material, such as TPU, may secure an electronic device to the shaft of the club.

A conducting wire may be any wire or filament capable of passing or displacing electrical charge along its length. Thus, a conducting wire may be used in a club that has separate electronic devices in the club head and shaft to allow the devices to communicate with each other. In this capacity, it is useful to have the conducting wire secured to the shaft of the club and electrically insulated from both the shaft and the external environment. Consequently, the thermoplastic material may form a membrane or sheath that surrounds the conducting wire to secure the wire and insulate the wire from the shaft, which may be made of conducting metal, and from external signals. Alternatively, a conducting wire may also serve as an antenna to receive radio waves from external sources. For this purpose, it is advantageous to have the conductive wire exposed to the environment. Therefore, the thermoplastic material may secure the conductive wire to the shaft and insulate the wire from the shaft but not from the environment.

The thermoplastic material may serve a protective function. During normal use, the head of a golf club suffers repeated impact not only from golf balls but also from rocks, stones, pebbles, sand, dirt, grass and the like. Additionally, the entire club is exposed to sunlight, which contains ultraviolet rays. This environmental exposure can affect both the structural surfaces of the club and the paint or other markings applied to the surfaces. A thermoplastic feature, such as a membrane that covers one or more surfaces of the club, can protect against these environmental insults.

The feature may be used to cover a recess on a surface of the club head. Many modern adjustable-loft clubs have removable or adjustable hosels secured to the club head body via a fastener, such as a screw or bolt. Such designs typically include a recess in the sole of the club head to accommodate the head of the fastener and prevent it from protruding from the sole. Alternatively, a club head may have a recess in its sole or crown to accommodate weighted inserts or weighting systems or to reduce drag. Exposed recesses on a club head can trap and retain dirt, grass, turf, sand, rocks, and other debris, which can affect the performance of the club. This problem can be solved, however, by covering the recess with a thermoplastic feature, such as a membrane, that creates a smooth or nearly smooth external surface to the club head without significantly affecting its mass distribution.

The club head may have a feature that improves turf interaction of the club. "Turf interaction" generally refers to the frictional interaction between the golf club and the ground. In most instances, it is desirable to minimize turf interaction, although sometimes increased turf interaction is advantageous. Addition of a thermoplastic feature to a portion of the club head, particularly the sole, can improve the turf interaction of the club head. The specific design of the feature influences how the club head interacts with the ground. Consequently, to improve turf interaction by reducing friction, the feature may have one or more rails or ribs that protrude from the sole and extend longitudinally from the ball-striking face to the rear of the club head. The rails may be components of a single feature, i.e., a single piece of thermoplastic material, or each rail may be a separate feature.

The thermoplastic feature may alter the sound that the club makes during a swing or when it contacts a golf ball. When a golf club having a feature produces a sound different from the sound produced by another club that lacks the feature but is otherwise identical, it is understood that the feature is responsible for the difference in sound and thus has altered the sound of the club. When a golf club is swung rapidly, as for hitting a golf ball, it typically makes a whistling or "whoosh" noise that depends in part on the shape of the club head. A feature may be used to change the contours of the club head to increase or decrease the volume or frequency of the noise produced by the swing. The structural elements of a club head also affect the sound made when the club strikes a ball. Consequently, the thermoplastic feature can be used to modify the volume, frequency, resonance, or timbre of the sound resulting from impact between the club head and ball.

The thermoplastic feature may have any shape or form that imparts the desired functionality to the golf club. Some examples of particular configurations of the feature, such as membranes, rails, or ribs, are given above, but other configurations are possible within the scope of the invention. For example and without limitation, the thermoplastic feature may have grooves, a web-like structure (e.g., intersecting linear portions), regularly-spaced shapes (e.g., circles, squares, rectangles, etc.), or the like.

The feature may form a pattern on a surface of the club head. The pattern may result from application of the feature to a smooth surface of the club head. Alternatively, the pattern may result from a combination of an applied thermoplastic feature and a pre-existing pattern on the surface of the club head, e.g., an initial pattern generated by casting. For example, the final pattern on the surface of the club head may include a portion of the surface with pre-cast elements, such as grooves, ridges, rails, etc., and another portion of the surface with elements, such as grooves, ridges, rails, etc., formed by the applied thermoplastic feature. Alternatively, the final pattern on the surface of the club head may result from layering a thermoplastic feature having a defined pattern over a pre-cast surface with an identical or complementary pattern. Thus, the elements, such as grooves, ridges, rails, etc., of the pattern may have a first portion of their height composed of the material of the club head surface and a second portion composed of a thermoplastic material. The use of such hybrid construction allows the generation of structurally sound ridges, rails, etc. of a greater height than for ridges, rails, etc. made solely of the thermoplastic material.

Figure 28:
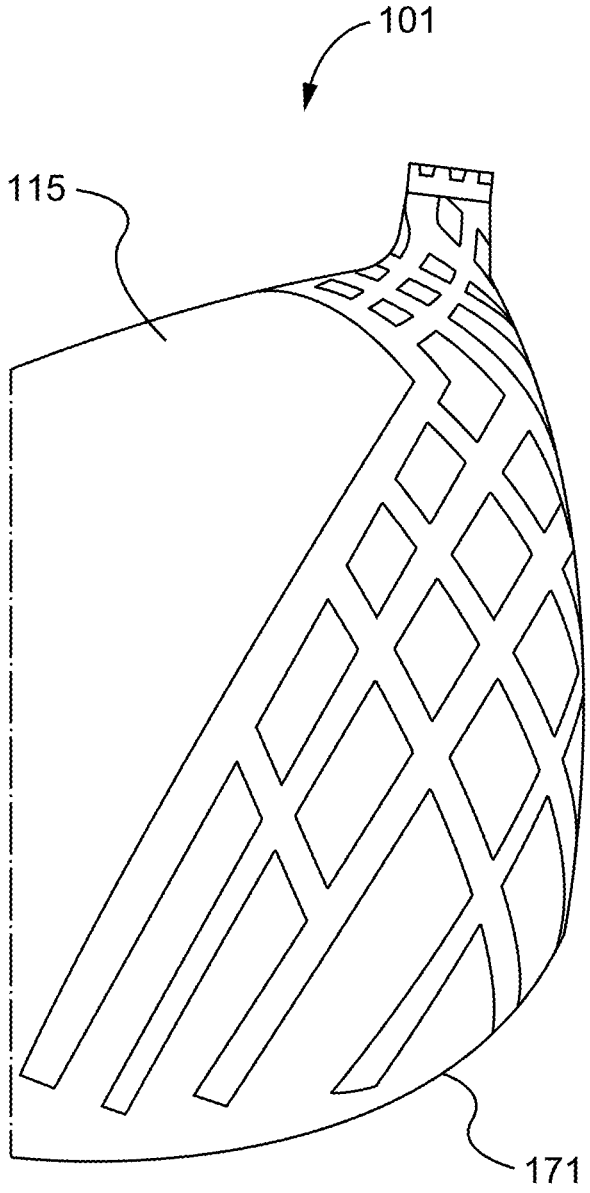
FIG. 28 shows the crown of the club head.

FIG. 28 shows the crown 115 of the club head 101 in an embodiment of the invention. The trip member 125 is provided by a web of thermoplastic polyurethane (TPU). The crown and the sole have been painted with paint and the web of TPU is adhered to a surface of the paint. The web of TPU can be laser-cut prior to being adhered to the painted club head. The TPU is preferably adhered to the crown, e.g., with an adhesive. In some embodiments, the trip members 125 are provided as a web of TPU or other such lightweight material. The material is laser-cut or otherwise prepared (e.g., die-cut or hand-cut) and provided as a decal of application to the club head.

An important feature of the trip members 125 is the aerodynamic functionality that they provide. The aerodynamic functionality is a product of the surface relief provided by the trips. It may be found that at least about 1 mm of relief provides the aerodynamic benefit. The benefit may arise from the relief, i.e., the un-smooth surface area, interrupting laminar flow of air. It may be most preferable to include the trip members on the crown, in the front-most 20% of the of the club head, i.e., closest to the ball-striking face. In a preferred embodiment, the trip member 125 provides relief once applied to the club head because the trip member 125 sits proud of the surface to which it is applied.

Figure 29:
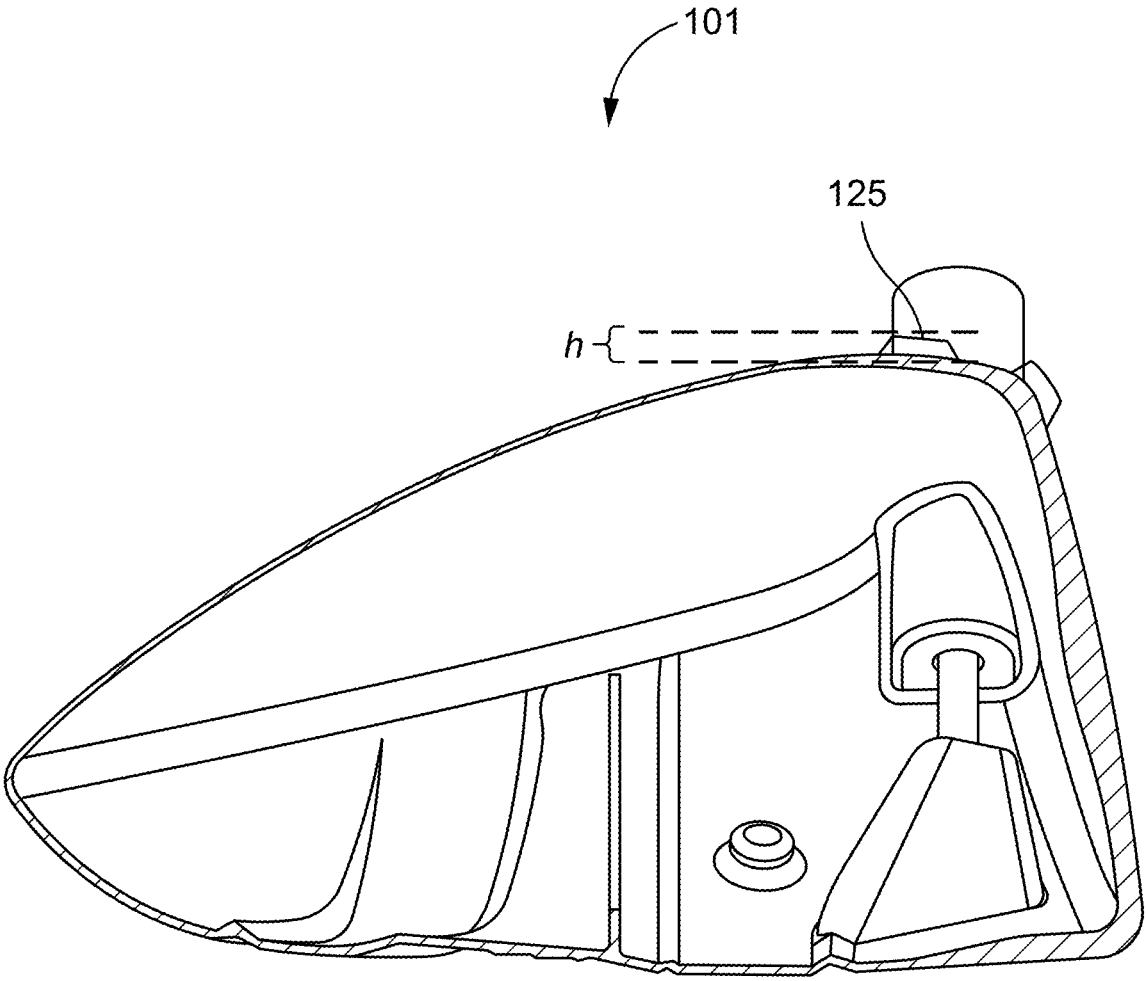
FIG. 29 shows that a trip member sits proud on the club head.

FIG. 29 shows that the trip members 125 sit proud on the club head 101. Preferably, the web of TPU creates spots of relief from the crown. The relief is provided by portions of the TPU that sit proud of the crown by a height, h. The height h may be about 0.3, about 0.4, about 0.5, about 1, about 1.5, about 2, about 2.5, or about 3 mm. When the club head 101 flies through the air during normal play, air flows over the surface of the club head. As predicted by aerodynamics, the air may initially form a boundary layer that exhibits laminar air flow. When the laminar boundary layer encounters the trip members 125, the trip members 125 trip the laminar flow into turbulent flow.

Figure 30:
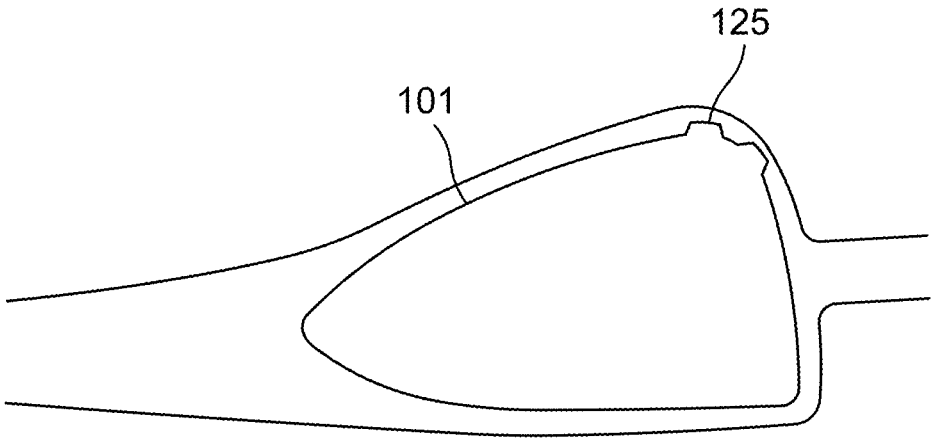
FIG. 30 shows how the trip member trips a boundary layer into turbulence.

FIG. 30 shows how the trip member trips a boundary layer into turbulence. When the club head 101 is swung through air, the trip member 125 (e.g., the web of TPU) sitting proud of crown trips the boundary layer into turbulence prior to the location of laminar separation. The fuller velocity profile of the turbulent boundary layer allows it to sustain the adverse pressure gradient without separating. Thus, although the skin friction may be increased, overall drag is decreased. This represents an optimum compromise between the pressure drag from flow separation and skin friction from induced turbulence.

One or a plurality of trip members 125 on the golf club head 101 cause the airflow of the boundary layer as it contacts the trip members 125 to trip or change from a laminar flow to a turbulent flow. The turbulent flow of the boundary layer "sticks" to the outer surface of the golf club head thereby delaying the separation point of the boundary layer. When the club head 101 is being swung through the air, the turbulent boundary layer does not separate from the crown at the same relative point as it does in a club head 501 that is the same but for the web of TPU.

Figure 31:
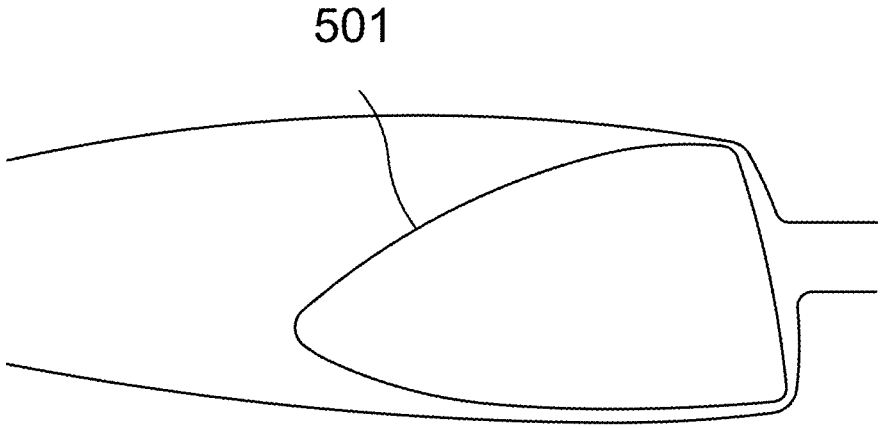
FIG. 31 illustrates a club head without a trip member.

FIG. 31 illustrates a club head 501 that is the same as club head 101 but for the trip member. In contrast to club head 101, the flow around club head 501 separates early over the club head. Thus the trip member 125 delay the flow separation. The delay in separation results in a lower drag coefficient and provides a slightly higher pressure behind the club head, which reduces the pressure differential between the air in front of and behind the club head thereby reducing the aerodynamic drag. For additional background, see U.S. Pub. 2016/0166891; U.S. Pub. 2013/0109494; U.S. Pub. 2013/0260927; U.S. Pub. 2010/0016095; U.S. Pub. 2002/0077165; and JP2009000281 (A), all incorporated by reference.

Embodiments of the invention include a polyurethane trip that is added to a golf club head or golf club to tune aerodynamic properties. The trip member may be added at any suitable location on a club head or golf club.

Figure 32:
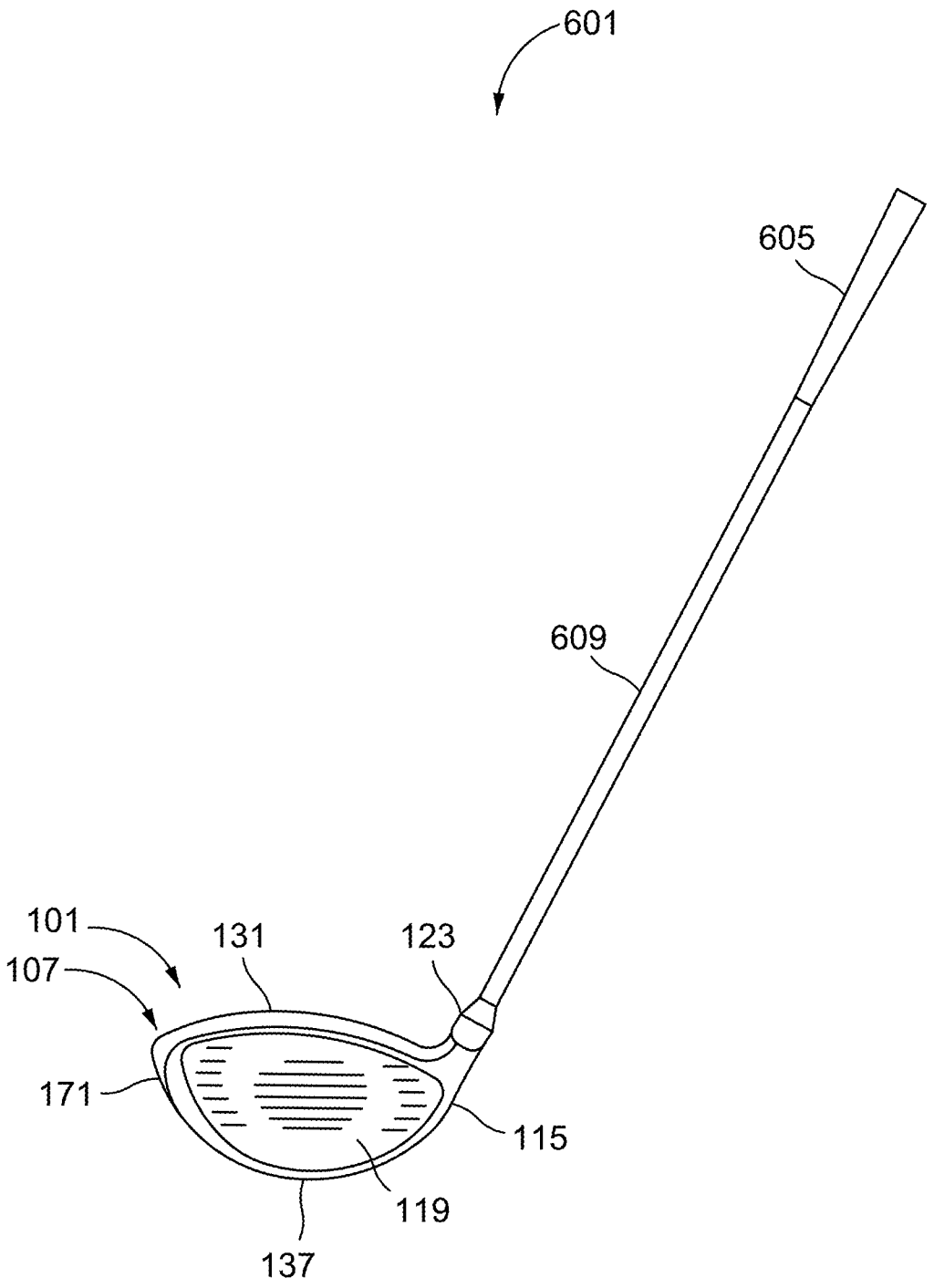
FIG. 32 shows a golf club that includes the golf club head.

FIG. 32 shows a golf club 601 that includes the golf club head 101. The golf club head 101 has a club head body 107 with a heel portion 115 and a toe portion 171, a ball-striking face 119 on a front of the club head body, and a hosel 123 extending upwards from the heel portion 115 of the club head body 107. The club head 101 preferably includes a crown 131 and a sole 137 extending back from the ball striking face 119, the crown 131 meeting the sole 137 at the heel portion, the toe portion 171, and an aft portion of the club head body. The golf club 601 includes a shaft 609 extending from the hosel 123 with a grip 605 mounted on a proximal end of the shaft. The golf club 601 includes a trip member 125 adhered to it. The trip member 125 may be adhered to the club head (e.g., to the crown) or to the hosel 123 or to the shaft 609.

Preferably, the club head 101 is a hollow, wood-type club head and more preferably, the golf club 601 is a driver. Preferably, the golf club head 101 is a driver-type club head with a club head volume of >440 cc. The club head body 107 includes a first material such as titanium. The trip member includes a second, lower density material. The club head 101 may optionally include a coat of finish (e.g., paint or clear coat) on an outer surface of the trip (e.g., covering the TPU and the club head body). The trip member 125 may be adhered to the club head 101 after initial casting and also optionally after painting or other finishing steps.

Figure 33:
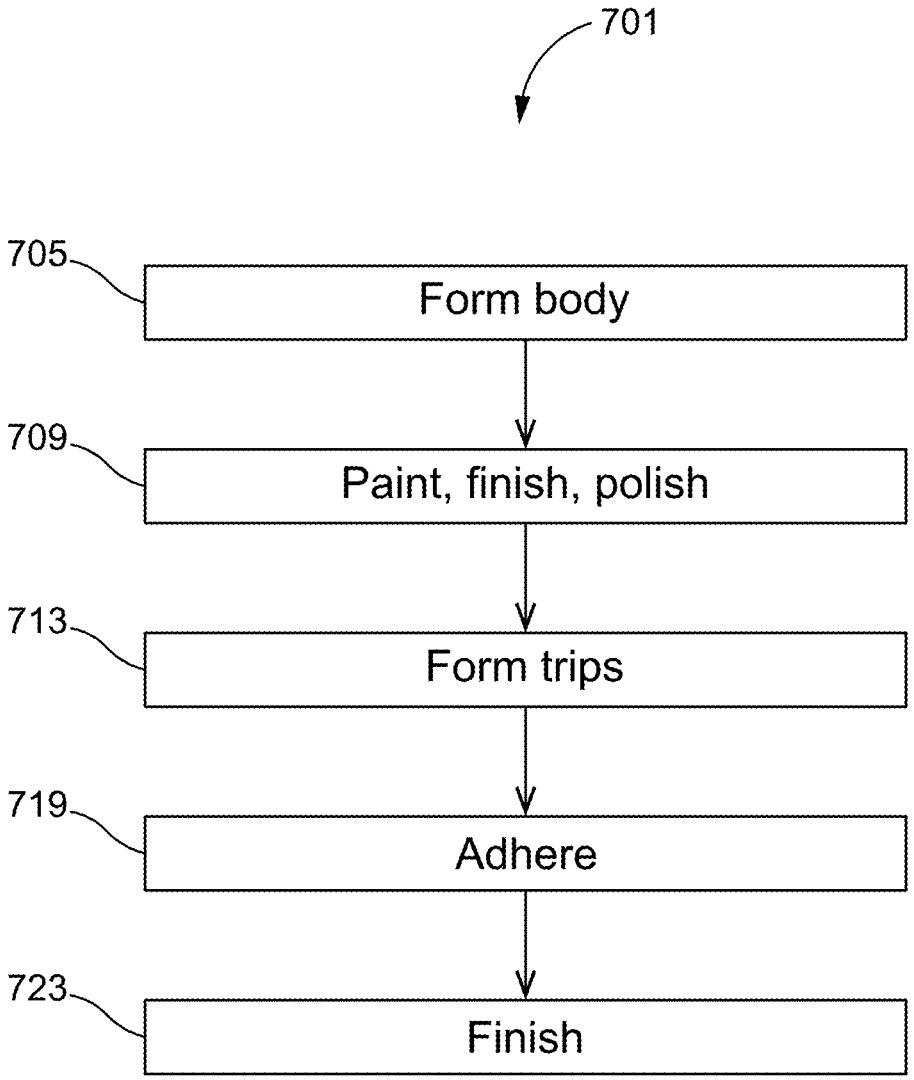
FIG. 33 diagrams a method of making the club head.

FIG. 33 diagrams a method 701 of making the club head 101. The method addresses difficulty in developing cast-in trips in club heads, including heads for drivers, wood-type club, hybrids, irons, and putters. The location of cast-in trips may interfere with polishing and finishing processes. To address those problems, the method 701 includes casting to form 705 a club head body 107. The body may be painted 709 with any optional finishing or polishing steps. The intended trips are formed 713, e.g., die-cut or laser-cut from a sheet of TPU. The trips are adhered 719 to the club head body. Finally, it may be desired to finish 723 the club head with any additional desired paint, decals, or clear coat that may cover part or all of the trips and other surrounding portions of the club head.

The trips that are adhered to the club head are not limited to being specifically aerodynamic boundary layer trips. Instead, it will be appreciated that the described methods may be used to provide the flexibility and ease of adding features to a head or a shaft, for any functional benefit. The methods may have particular benefit in provided features that are difficult or impossible to cast or forge.

The terms "trip" and "aerodynamic feature" are interchangeably herein, and it is understood that descriptions of aspects a one term apply equally to the other.

INCORPORATION BY REFERENCE

References and citations to other documents, such as patents, patent applications, patent publications, journals, books, papers, web contents, have been made throughout this disclosure. All such documents are hereby incorporated herein by reference in their entirety for all purposes.

EQUIVALENTS

Various modifications of the invention and many further embodiments thereof, in addition to those shown and described herein, will become apparent to those skilled in the art from the full contents of this document, including references to the scientific and patent literature cited herein. The subject matter herein contains important information, exemplification and guidance that can be adapted to the practice of this invention in its various embodiments and equivalents thereof.

What is claimed is:

1. A golf club head comprising:

a ball-striking face comprising:

a central region comprising a first pattern of surface roughness that is symmetric in all directions about a center point of the face, and a peripheral region comprising a second pattern of surface roughness that is different than the first pattern of surface roughness, wherein the second pattern of surface roughness surrounds the central region and comprises a radial pattern with structural features linear and extending radially outward along lines that extend through the center point in more than just one direction and 180 degrees opposite that said one direction;

a crown extending back from the face when the club head is at address;

a sole extending back from the face to meet the crown; and a hosel extending upwards from a heel side of the club head.

2. The golf club head of claim 1, wherein the central region comprises a milled surface.

3. The golf club head of claim 1, wherein the central region comprises structural features having a mean relief of from about 100 microinches to about 180 microinches.

4. The golf club head of claim 1, wherein the central region comprises structural features having a maximum relief of from about 600 microinches to about 1000 microinches.

5. The golf club head of claim 1, wherein the first pattern comprises concentric circles.

6. The golf club head of claim 1, wherein the central region comprises structural features comprising a cross-sectional shape relative to an axis orthogonal to the face, the shape being a sinusoidal wave.

7. The golf club head of claim 1, wherein the peripheral region comprises the structural features having a mean relief of from about 50 microinches to about 150 microinches.

8. The golf club head of claim 1, wherein the peripheral region comprises the structural features having a maximum relief of from about 400 microinches to about 900 microinches.

9. The golf club head of claim 1, wherein the face has a bulge radius.

10. The golf club head of claim 1, wherein the face has a loft angle of less than 20° when the head is at address.

11. The golf club head of claim 1, wherein the club head is a hollow club head.

12. The golf club head of claim 11, wherein the club head is a wood-type club head.

13. A golf club head comprising:

a crown extending back from a ball striking face when the club head is at address;

a sole extending back from the ball striking face to meet the crown; and a hosel extending upwards from a heel side of the club head, the ball striking face comprising:

a first region having a first surface roughness comprising a circular pattern that is symmetric about a center point of the face, a second region having a second surface roughness that is different than the first surface roughness, the second region comprising a radial pattern with structural features linear and extending radially outward along lines that extend through the center point in more than just one direction and 180 degrees opposite that said one direction point, wherein the first region is disposed interior to the second region.

14. The golf club head of claim 13, wherein the first region comprises a milled surface.

15. The golf club head of claim 13, wherein the club head is a wood-type club head.

16. The golf club head of claim 13, wherein the first region extends from the center point of the ball striking face to a position adjacent to a top edge and a bottom edge of the ball striking face.

17. The golf club head of claim 13, wherein when a ball is aligned with the center point of the ball striking face during impact, the ball contacts the ball striking face within the first region throughout impact.

18. The golf club head of claim 13, wherein the first region includes a series of concentric circles around the center point.

19. The golf club head of claim 13, wherein the first region extends from the center point of the ball striking face to a position spaced from a top edge and a bottom edge of the ball striking face.

* * * * *